US005481352A

United States Patent [19]

Yamamoto et al.

[11] Patent Number: 5,481,352

[45] Date of Patent: Jan. 2, 1996

[54] IMAGE FORMING APPARATUS USING A CONTINUOUS PAPER SUPPLY

[75] Inventors: Yoshikazu Yamamoto; Akio Itabashi, both of Kawasaki, Japan

[73] Assignee: Fujitsu Limited, Kawasaki, Japan

[21] Appl. No.: 214,314

[22] Filed: Mar. 17, 1994

[30] Foreign Application Priority Data

Mar. 19, 1993 [JP] Japan ..... 5-060001
Mar. 1, 1994 [JP] Japan ..... 6-031325

[51] Int. Cl.[6] ..... G03G 15/00

[52] U.S. Cl. ..... 355/308; 355/271; 355/273; 355/309; 355/321

[58] Field of Search ..... 355/271, 273–276, 355/308, 311, 309, 310, 321; 271/264, 265, 270, 275, 306, 188, 202, 3

[56] References Cited

U.S. PATENT DOCUMENTS

| | | | |
|---|---|---|---|
| 4,110,027 | 8/1978 | Sato et al. . | |
| 4,306,800 | 12/1981 | Kopp . | |
| 4,392,738 | 7/1983 | Fujino et al. . | |
| 4,443,091 | 4/1984 | Ainoya et al. . | |
| 4,526,309 | 7/1985 | Taylor et al. | 355/311 X |
| 4,929,982 | 5/1990 | Ainoya et al. | 355/274 X |
| 4,943,863 | 7/1990 | Ainoya et al. | 355/271 |
| 4,963,941 | 10/1990 | Negishi et al. | 355/271 X |
| 5,023,667 | 6/1991 | Negoro et al. | 355/274 |
| 5,105,227 | 4/1992 | Kitamura et al. | 355/274 |
| 5,155,539 | 10/1992 | Yamaguchi et al. | 355/274 X |
| 5,179,417 | 1/1993 | Sugaya et al. | 355/274 X |
| 5,220,396 | 6/1993 | Monma et al. | 355/274 X |
| 5,296,906 | 3/1994 | Hano et al. | 355/311 |
| 5,317,371 | 5/1994 | Monma et al. | 355/274 |

FOREIGN PATENT DOCUMENTS 0141472 5/1992 Japan .

*Primary Examiner*—Matthew S. Smith
*Attorney, Agent, or Firm*—Staas & Halsey

[57] ABSTRACT

An image forming apparatus such as an electrophotographic printer forms an image on paper fed from a continuous paper supply in a first direction. A photosensitive drum carries a toner image and a transfer guide selectively moves the paper between a first position in which the paper contacts the drum and a second position in which the paper is separated from the drum. A tractor and a scuff roller are provided downstream of the transfer guide, relatively to the feed direction of the paper. A controller controls the tractor and the scuff roller so as to produce a relative velocity difference therebetween during an operation in which the paper, as fed from the continuous paper supply, is moved by the transfer guide.

60 Claims, 12 Drawing Sheets

IMAGE FORMING APPARATUS USING A CONTINUOUS PAPER SUPPLY

BACKGROUND OF THE INVENTION

1. Field of the Invention

The present invention relates to an image forming apparatus using continuous paper supply.

With the recent progress in the art of high speed computer systems, a printer, as an output apparatus of the high speed computer system, is required to ensure high speed operation and high reliability of the printing operation. An image forming apparatus, such as an electrophotographic printer, etc. is expected to meet such requirements. Electrophotographic printers are widely used now, in the form of laser beam printers and LED array printers. These printers have a feature that printed papers may be output at a high speed.

The electrophotographic printer, such as a laser beam printer or an LED array printer, forms a toner image on a recording sheet by executing the processes explained in the following. First, a photosensitive drum, as a toner carrying member, is uniformly charged in either a positive or a negative polarity. Next, the photosensitive drum is exposed depending upon input image information and thereby an electrostatic latent image is formed on such photosensitive drum.

An electrostatic latent image on the photosensitive drum is developed by using a toner which is charged in the same polarity as the charged polarity of the photosensitive drum. That is, since a toner is attached with an electrostatic force on an exposed area of the photosensitive drum, a toner image can be formed on the photosensitive drum. The toner image on the photosensitive drum is then transferred onto a recording sheet, usually by a transfer corona, in a transfer station. As the recording sheet, a continuous paper or a cut sheet is used. As the continuous paper, a rolled paper or a folded sheet can be used.

2. Description of the Related Art

A paper transfer mechanism provided in an electrophotographic printer of a prior art mechanism, using paper from a continuous paper supply is provided with a transfer guide mechanism for contacting the paper of the continuous paper with the photosensitive drum and for separating the paper of the continuous paper from the photosensitive drum. This transfer guide mechanism is provided with a means for equalizing the paper transfer route length when the continuous paper is closely contacted with the photosensitive drum and when the continuous paper is separated therefrom. Such paper transfer mechanism has been published in the Japanese Laid-Open Patent No. SHO 53-21934.

A paper transfer mechanism different from the paper transfer mechanism disclosed in the above Japanese Patent was made public in the Japanese Laid-Open Patent No. SHO 50-34543. This paper transfer mechanism is provided with a movable guide which executes forcible separation of the continuous paper from the photosensitive drum by pushing the continuous paper toward the upstream side of the transfer section, taken in view of the photosensitive drum.

The paper transfer apparatus of the prior art comprising the transfer guide means explained above has a problem in that the configuration of the transfer guide means is rather complicated. Meanwhile, the paper transfer mechanism comprising the movable guide causes the continuous paper to be loosened, by as much as the distance moved by the movable guide during the transfer process.

When the continuous paper is loosened, it scrubs the photosensitive drum or contacts with an upper paper guide. This may happen during an operation in which the continuous paper comes in contact with the photosensitive drum or during a transfer operation. Thereby, there is a possibility that toner is separated from the continuous paper and/or the photosensitive drum, or that a surface of the photosensitive drum is damaged.

SUMMARY OF THE INVENTION

It is an object of the present invention to provide an image forming apparatus which can quickly and accurately separate a continuous paper from a toner carrying member.

It is another object of the present invention to provide an image forming apparatus which eliminates loosening of the continuous paper in a transfer section.

It is another object of the present invention to provide an image forming apparatus which never results in separation of toner from a continuous paper and/or toner carrying member and does not scratch the toner carrying member.

It is a further object of the present invention to provide an image forming apparatus comprising a simplified structure of transfer guide means.

It is still a further object of the present invention to provide an image forming apparatus comprising a paper transfer mechanism which always can apply tension to a continuous paper.

Additional objects and advantages of the present invention will be set forth in the description which follows, and, in part, will be clear from the description, or may be learned by practice of the invention. The objects and advantages of the invention may be realized and obtained by means of the instrumentalities and combinations particularly pointed out in the appended claims.

To achieve the foregoing objects and in accordance with the purpose of the invention as embodied and broadly described herein, there is provided an image forming apparatus using paper of a continuous paper supply, comprising: a toner carrying member carrying a toner image; transfer guide means for moving the continuous paper so that the continuous paper is in contact with said toner carrying member and is separated from said toner carrying member; roller means, provided at a downstream side of said transfer guide member, taken in view of a feeding direction of the continuous paper, for feeding the continuous paper; and control means for controlling said roller so that said roller means feed the continuous paper at a velocity faster than a surface velocity of said toner carrying member during a moving operation in which the continuous paper is moved by said transfer guide means.

According to a further aspect of the invention, there is provided an image forming apparatus using paper from a continuous paper supply, comprising: a toner carrying member carrying a toner image; transfer guide means for moving the continuous paper so that the continuous paper is in contact with said toner carrying member and then is separated from said toner carrying member; a tractor, provided at an upstream side of said transfer guide member, taken in view of a feeding direction of the continuous paper, for feeding the continuous paper; roller means, provided at a downstream side of said transfer guide member, taken in view of a feeding direction of the continuous paper, for feeding the continuous paper; means for generating a driving force for driving said tractor and said roller means; a one-way clutch for transmitting the driving force to said roller means; and control means, operatively connected to said generating means, for stopping generation of the driving of said generating means so that the roller means continue to rotate by an inertia force of said roller means during a moving operation in which the continuous paper is moved by said transfer guide means.

According to a further aspect of the invention, there is provided an image forming apparatus using paper from a continuous paper supply, comprising: a toner carrying member carrying a toner image; transfer guide means for moving the continuous paper so that the continuous paper is in contact with said toner carrying member and is separated from said toner carrying member; front side feeding means, provided at an upstream side of said transfer guide member, taken in view of a feeding direction of the continuous paper, for feeding the continuous paper; back side feeding means, provided at a downstream side of said transfer guide member, taken in view of a feeding direction of the continuous paper, for feeding the continuous paper; and control means for controlling said front side feeding means and said back side feeding means so that a feeding velocity of said back side feeding means feeds the continuous paper at a velocity faster than a feeding velocity of said front side feeding means during a moving operation in which the continuous paper is moved by said transfer guide means.

According to a further aspect of the invention, there is provided an image forming apparatus using paper from a continuous paper supply, comprising: a toner carrying member carrying a toner image; transfer guide means for moving the continuous paper so that the continuous paper is in contact with said toner carrying member and is separated from said toner carrying member; front side feeding means, provided at an upstream side of said transfer guide member, taken in view of a feeding direction of the continuous paper, for feeding the continuous paper; back side feeding means, provided at a downstream side of said transfer guide member, taken in view of a feeding direction of the continuous paper, for feeding the continuous paper; means for detecting a feeding velocity of the continuous paper; means for determining a slip state of the continuous paper based upon the feeding velocity detected by said detecting means; and control means for controlling said front side feeding means and said back side feeding means in accordance with the slip state so that a feeding velocity of said back side feeding means feeds the continuous paper at a velocity faster than a feeding velocity of said front side feeding means during a moving operation in which the continuous paper is moved by said transfer guide means.

According to a further aspect of the invention, there is provided an image forming apparatus using paper from a continuous paper supply, comprising: a toner carrying member carrying a toner image; transfer guide means for moving the continuous paper so that the continuous paper is in contact with said toner carrying member and is separated from said toner carrying member; front side feeding means, provided at an upstream side of said transfer guide member, taken in view of a feeding direction of the continuous paper, for feeding the continuous paper; back side feeding means, provided at a downstream side of said transfer guide member, taken in view of a feeding direction of the continuous paper, for feeding the continuous paper; means for inputting an information indicating a type of the continuous paper; control means for controlling said front side feeding means and said back side feeding means in accordance with the information so that a feeding velocity of said back side feeding means feeds the continuous paper at a velocity faster than a feeding velocity of said front side feeding means during a moving operation in which the continuous paper is moved by said transfer guide means.

BRIEF DESCRIPTION OF THE DRAWINGS

The accompanying drawings, which are incorporated in and constitute a part of the specification, illustrate embodiments of the invention and, together with the description, serve to explain the principles of the invention. In the drawings, like numerals refer to like parts throughout.

DETAILED DESCRIPTION OF THE PREFERRED EMBODIMENTS

Reference will now be made in detail to the present preferred embodiments of the invention, examples of which are illustrated in the accompanying drawings. The preferred embodiments of the invention will be explained with reference to the accompanying drawings. First, a first embodiment of the present invention will be explained by referring to FIG. 1.

Figure 1:
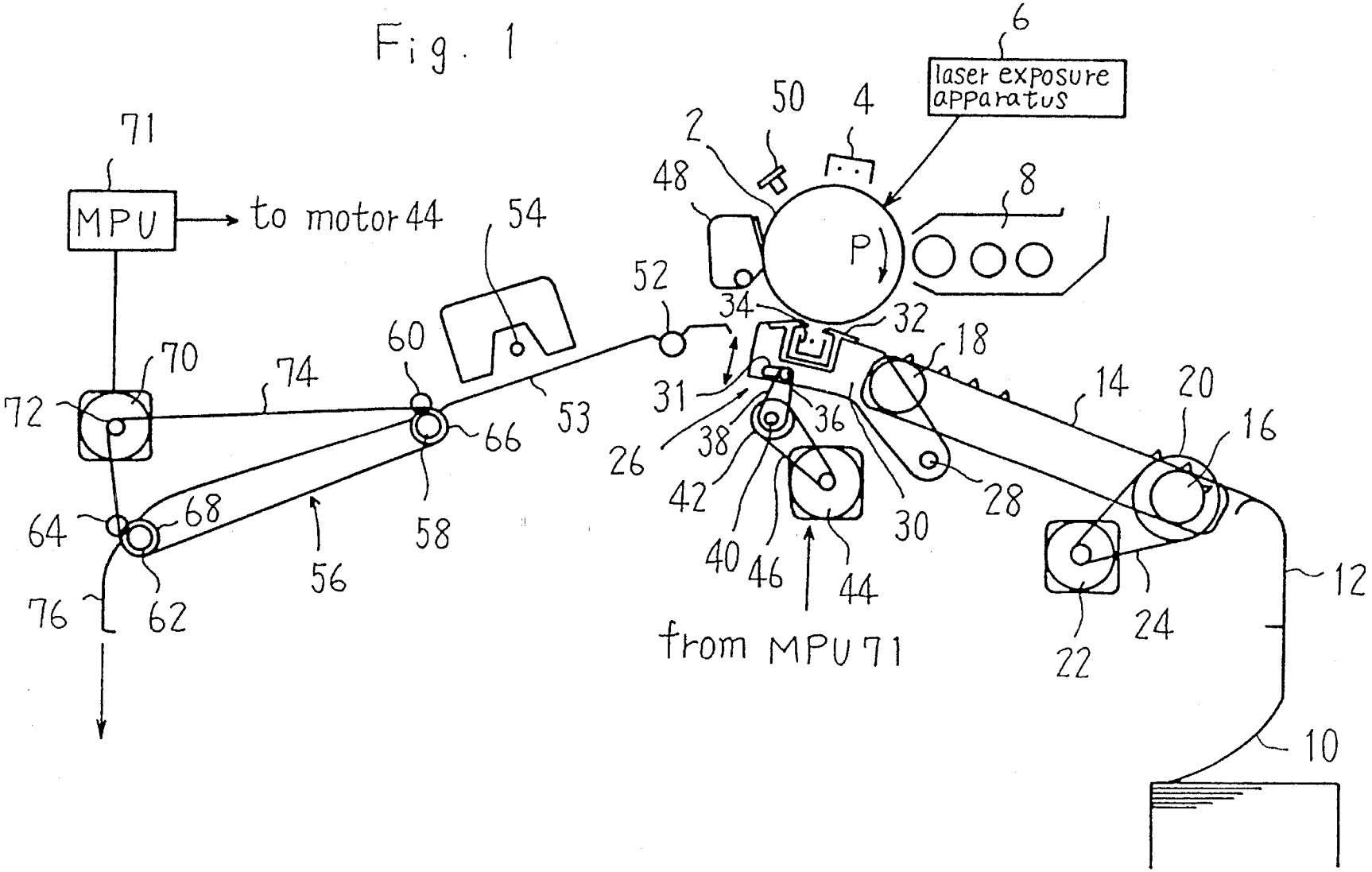
FIG. 1 is a schematic diagram of a configuration of a first embodiment of the present invention.

FIG. 1 is a schematic diagram of a configuration of a first embodiment of the present invention. In FIG. 1, a photosensitive drum 2 is rotatably driven in a direction indicated by an arrow mark P. As the photosensitive drum 2, an amorphous silicon photosensitive drum, an organic photosensitive drum or the like is used. The photosensitive drum is not limited only to a drum shape and may be implemented in the shape of a belt. The photosensitive drum 2 corresponds to a toner carrying member. An image forming apparatus, such as a printer or a duplicator in an electrophotographic system, uses a photosensitive material. An image forming apparatus of an electrostatic recording system uses an electrostatic recording material.

Next, the photosensitive drum 2 is uniformly charged in a predetermined polarity, for example, in a negative polarity with a corona discharge unit 4. The photosensitive drum 2 is then exposed, in accordance with image information, by a laser exposing unit 6 to form a resultant electrostatic latent image thereon. The laser exposing unit 6 scanningly exposes a surface of the photosensitive drum 2 through a rotating polygon-mirror with a laser beam modulated depending on the image information. The laser exposing unit 6 is well known in the art. An exposing unit such as the laser exposing unit 6 is not limited to a laser exposing unit and various other well known units, such as an LED exposing unit, can be used.

An electrostatic latent image formed on the photosensitive drum 2 is then developed by a developing unit 8, such as a magnetic brush developing unit using a toner to form a toner image on the photosensitive drum 2. The toner is frictionally charged in the same polarity as the photosensitive drum 2.

Meanwhile, paper from a continuous recording paper supply 10 is fed to a transfer station by a tractor 14. The continuous recording paper 10 is formed as a fan-fold paper with sprocket holes. The continuous paper 10 is folded at each scoring line and is then accommodated within a hopper in the image forming apparatus or within a box provided outside the image forming apparatus. The sprocket holes of the continuous paper 10 are provided at both sides of the continuous paper 10 and with a predetermined pitch. The continuous paper 10 is fed in synchronization with rotation of the tractor 14, while the sprocket holes thereof couple with sprockets of the tractor 14.

Therefore, paper from the continuous paper supply 10 is fed to the transfer station from the hopper or the box while the continuous paper 10 is guided by a guide 12.

The tractor 14 comprises a driving sprocket 16, a driven sprocket 18 and an endless belt extended over both sprockets 16, 18. The driving sprocket 16 is fixed coaxially with a pulley 20. A driving force of a tractor driving motor 22 is transmitted to the driving sprocket 16 via a timing belt 24 and the pulley 20.

When the tractor driving motor 22 is driven, the driving sprocket 16 is rotated via the timing belt 24 and the pulley 20 and thereby the tractor 14 transfers the continuous paper 10 in a direction toward the transfer station. That is, the continuous paper 10 is transferred toward a region between the photosensitive drum 2 and the transfer corona charger 34 within a transfer guide means. The region is provided corresponding to the transfer station or a transfer portion.

A transfer guide means 26 guides the continuous paper 10, transferred by the tractor 14, within the transfer station. The transfer guide means 26 transfers the continuous paper 10 both into a transfer position where the continuous paper 10 is closely contacted to the photosensitive drum 2 and into a separating position where the continuous paper 10 is separated from the photosensitive drum 2. The transfer guide means 26 transfers the continuous paper 10 between the transfer position (contact position) and the separating position (stand-by position).

The transfer guide means 26 further comprises a rotating member 30 which rotates around a shaft 28. The rotating member 30 is provided with a paper guide 32 for guiding the continuous paper 10. The paper guide 32 extends in an axial direction of the photosensitive drum 2. The paper guide 32 has a cross-sectional shape approximating the alphabet letter U and is provided interiorly thereof with a built-in transfer corona charger 34.

An arcuate, elongated hole 31 is formed at a lower portion of an end of the rotating member 30. The elongated hole 31 allows insertion of a pin 36 which is fixed at one end portion of a link 38. The other end portion of the link 38 is fixed to a shaft 40. Moreover, a pulley 42 is also fixed to the shaft 40.

A reversibly rotatable pulse motor 44, for rotatably moving the transfer guide means 26 around the shaft 28, imparts a rotating force thereof to the pulley 42 through a timing belt 46. In FIG. 1, when the pulse motor 44 rotates clockwise, its rotating force is transmitted to the rotating member 30 via the timing belt 46, the pulley 42, the shaft 40 and the link 38. When the rotating member 30 rotates clockwise around the shaft 28, the paper guide 32 is positioned to guide the continuous paper 10 under a condition that a portion of the continuous paper 10 is located in close contact with the photosensitive drum 2. Namely, FIG. 1 illustrates the condition in which the transfer guide means 26 is located in the transfer position.

The amount of rotation of the transfer guide means 26 can be restricted, usually depending on a number of pulses of the pulse motor 44. A mechanical stopper, not illustrated, is also provided for restricting rotation of the rotating member 30. When the rotating member 30 is forced to collide with the stopper, such as when a power switch is turned on and when recovering from a failure, positioning to an initial position of the rotating member 30 can be achieved.

When the continuous paper 10 is moved to the separating position from the transfer position, the pulse motor 44 is rotatably driven in a counterclockwise direction from a position shown in FIG. 1. The link 38 rotates counterclockwise as the pulse motor 44 rotates. With a rotating operation of the link 38, the pin 36 fixed to the link 38 is in contact with the other end portion of the elongated hole 31 of the rotating member 30 and thereafter the rotating member 30 is caused to rotate counterclockwise around the shaft 28. Until the transfer guide means 26 reaches the separating position, the pulse motor 44 is rotatably driven.

When the transfer guide means 26 moves to the separating position, a feeding route of the continuous paper 10 in the transfer station changes. Therefore, the continuous paper 10 can be separated from the photosensitive drum 2. Rotation of the link 38, up to the separating position of the transfer guide means 26, is restricted depending upon the number of pulses given to the pulse motor 44.

Meanwhile, the continuous paper 10 can be moved to the transfer position from the separating position by reversing a rotating direction of the pulse motor 44 described above.

When the continuous paper 10, located at the transfer position by the transfer guide means 26, is subjected to DC corona discharge in a reverse polarity of the toner with the transfer corona charger 34 from a rear surface of the continuous paper 10, it is closely contacted with the photosensitive drum 2. Simultaneously, a toner image on the photosensitive drum 2 is electrostatically attracted to the continuous paper 10 and thereby the toner image is transferred to the continuous paper 10.

After the transfer operation, toner remaining on the photosensitive drum 2 is cleaned by a cleaner 48 and the photosensitive drum 2 is discharged by a discharging lamp 50. A single print cycle is completed by executing the operations explained above.

The toner image transferred onto the continuous paper 10 is fixed by a fuser 54. The continuous paper 10, on which the toner image is fixed, is folded and accommodated within a stacker (not shown in drawings) or exhausted to an outside (i.e., the exterior) of the image forming apparatus.

In this case, the continuous paper 10 is further transferred by a scuff roller unit 56, while it is guided by a guide roller 52 and a paper guide 53, and is then exhausted to an outside (i.e., the exterior) of the image forming apparatus. As the fuser 54, a heat roller fusing unit and a radiant heat fusing unit or the like may be used. In this embodiment, a flash fusing unit comprising a xenon lamp is used as the fuser 54. The flash fusing unit usually does not comprise a paper transfer means. The continuous paper 10, transferred to a front surface of the flash fusing unit, must always be transferred under a condition such that the continuous paper 10 is placed under tension, so that the continuous paper 10 does not contact with a glass plate (not illustrated) of the flash fusing unit. Therefore, the scuff roller unit 56 is provided at a position in a downstream side of the flash fusing unit, in order to transfer the continuous paper 10 under a condition that the continuous paper 10 is placed under tension.

The scuff roller unit 56 comprises two roller pairs, each pair including a scuff roller and a pinch roller. The pinch roller 60 is pressured into contact with the scuff roller 58 and the pinch roller 64 is pressured into contact with the scuff roller 62.

The scuff roller 58 is fixed coaxially with a pulley 66. The scuff roller 62, on the other hand, is coaxially fixed with a pulley 68. An endless timing belt 74 is extended over the pulleys 66, 68. A pulley 72 is fixed at an output shaft of scuff roller driving motor 70.

The scuff roller driving motor 70 is connected with a micro processor unit (MPU) 71, provided for controlling operations of a printer as an image forming apparatus. The MPU 71 controls rotation of the scuff roller driving motor 70. A surface velocity value of the scuff rollers 58, 62 is set to a value a little higher than a transfer velocity of the continuous paper 10, as fed by the tractor 14. Accordingly, the scuff rollers 58, 62 transfer the continuous paper 10 toward a stacker while the scuff rollers 58, 62 are slightly sliding on a surface of the continuous paper 10.

Due to the effect of the scuff rollers 58, 62, the continuous paper 10 is always placed under tension while it is transferred by the tractor 14 and the scuff rollers 58, 62. As a result, the continuous paper 10 is transferred, during the toner image transfer operation, through a paper transfer route formed by the tractor 14, the transfer guide means 26 and the scuff roller 58, resulting in no loosening thereof.

As is understood from FIG. 1, a transfer route of the continuous paper 10, established by the tractor 14, the transfer guide means 26 and the scuff roller 58, is curved upwardly including a projecting portion. In this embodiment, a transfer route length of the continuous paper 10 varies depending upon a position of the transfer guide means 26 between the sprocket located in the extreme left position, among the positions of the tractor 14 and the guide roller 52. The transfer route length of the continuous paper 10 becomes the shortest when the transfer guide means 26 is located in the stand-by position and becomes the longest when the transfer guide means 26 is located in the transfer position.

An operation of the embodiment will now be explained in the following. During a printing operation of an image forming apparatus (called a printer apparatus hereinafter), the transfer guide means 26 is rotated up to the transfer position illustrated in FIG. 1 and thereby the continuous paper 10 is guided at a close contact position at which the continuous paper 10 is in contact with the photosensitive drum 2. Moreover, the MPU 71 controls the scuff roller driving motor 70 so that a transfer velocity of the continuous paper 10, produced by the scuff roller unit 56, is faster than a surface velocity of the photosensitive drum 2 by about 4%. The surface velocity of the photosensitive drum 2 means a moving velocity at the external circumferential surface, that is, a circumferential velocity of the photosensitive drum 2.

As explained, since a paper transfer velocity of the scuff roller unit 56 is set to a velocity higher than a surface velocity of the photosensitive drum 2, loosening of the continuous paper 10 is never produced during an image transfer operation onto the continuous paper 10.

Upon completion of the image transfer operation onto the continuous paper 10, the MPU 71 sends a driving pulse to the pulse motor 44, in synchronization with a timing where a scored line of the continuous paper 10 reaches the transfer station, causing the transfer guide means 26 to rotate counterclockwise. Thereby, the transfer guide means 26 starts to move toward the separating position from the transfer position.

Meanwhile, the MPU 71 initiates an increase of a rotating velocity of the scuff roller driving motor 70 a short time before the sending of the driving pulse to the pulse motor 44. The MPU 71 increases the rotating velocity of the scuff roller driving motor 70 by about 50%. Thereby, on the occasion of moving the continuous paper 10 with the transfer guide means 26, the continuous paper 10 is given tension by the scuff rollers 58, 62 and is then separated quickly and accurately from the photosensitive drum 2.

The MPU 71 also controls the scuff roller driving motor 70, a short time after the arrival of the transfer guide means 26 at the separating position, so that the transfer velocity of the continuous paper 10 at the scuff roller unit 56 matches the transfer velocity of the continuous paper 10 at the tractor 14. A moving time, required by the transfer guide means 26 to move to the separating position from the transfer position, can be previously obtained by calculation as a design value. The MPU 71 determines a deceleration start time on the basis of moving time information in order to control the scuff roller driving motor 70. Therefore, a period where the transfer velocity of the continuous paper 10 by the scuff rollers 58, 62 is relatively faster than that of the tractor 14, and is a little longer than a period required by the transfer guide means 26 to move to the transfer position from the separating position.

Moreover, the MPU 71 controls the motor 22, for driving the tractor 14, to stop so that the continuous paper 10 stops after separation thereof from the photosensitive drum 2, when the scored line of the continuous paper 10 is transferred by a distance of about ½ inch from the transfer position. Therefore, the MPU 71 controls the scuff roller driving motor 70 to stop in synchronization with the stop and drive control of the motor 22.

In this embodiment, as explained above, since control is performed so that the transfer velocity of the scuff roller unit 56 becomes sufficiently faster than the circumferential velocity of the photosensitive drum 2 during the predetermined period from stoppage of printing, loosening of the continuous paper 10 is prevented when the printing operation stops. Thereby, the continuous paper 10 never contacts with mechanical parts such as the photosensitive drum 2 and the fuser 54, etc. during stoppage of the printing operation or at a time of restarting of the printing operation. Accordingly, it never occurs that the continuous paper 10 is contaminated by the toner remaining on the photosensitive drum 2 or that a toner image on the continuous paper 10 is disturbed.

Figure 2:
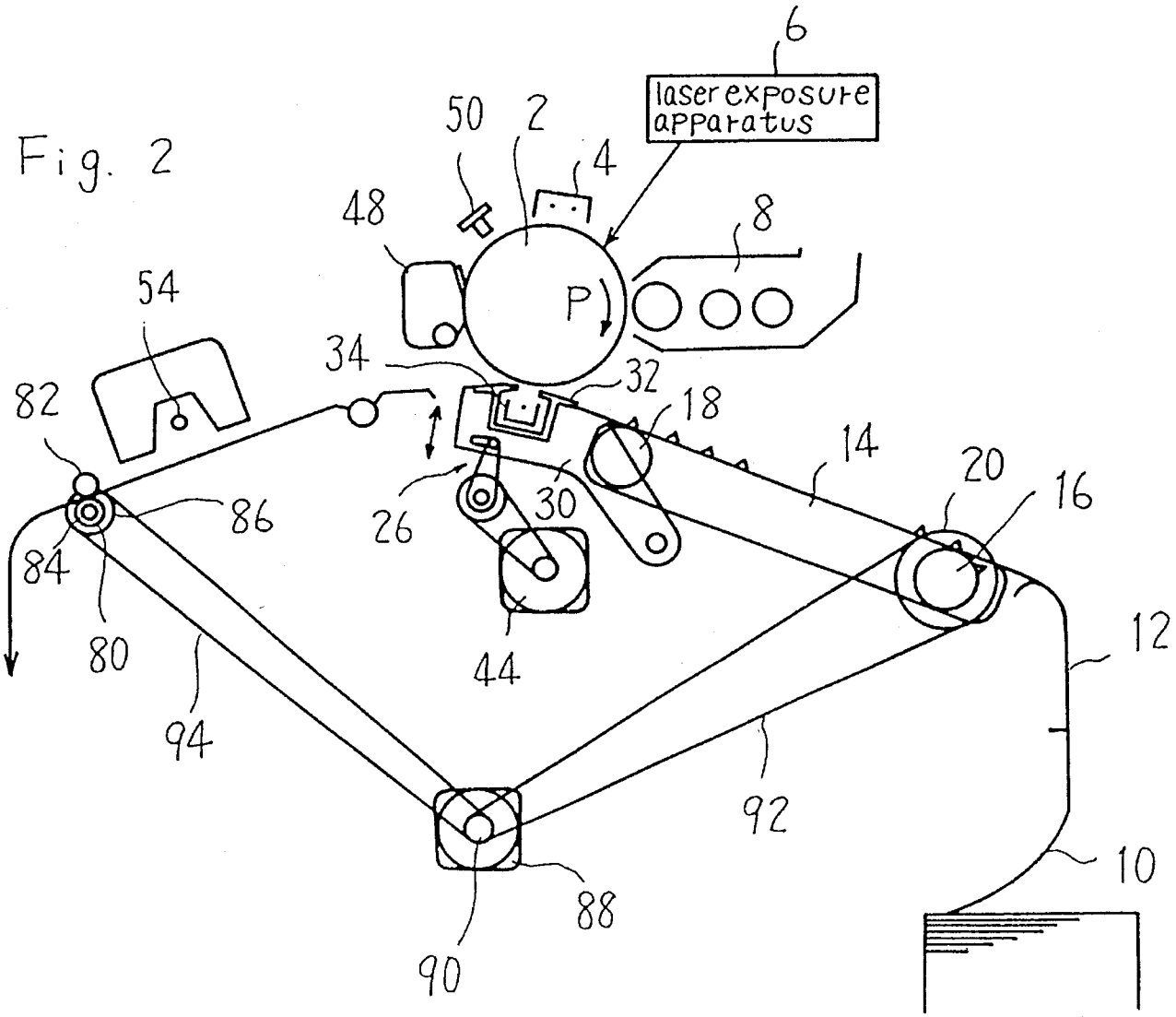
FIG. 2 is a schematic diagram of a configuration of a second embodiment of the present invention.

FIG. 2 is a schematic diagram of a configuration of a second embodiment of the present invention. In FIG. 2, structural elements like those in FIG. 1 are defined with like reference numerals, and explanation thereof is not repeated here.

In this embodiment, an image forming apparatus comprises a motor 88 connected in common with a tractor 14 and a scuff roller 80 and a one-way clutch 96 (illustrated in FIG. 3) built in between a shaft 84 fixing the scuff roller 80 and a pulley 86. This one-way clutch 96 can transfer a driving force thereof only in a direction preset for transferring the continuous paper, so that the scuff roller 80 can exhaust the continuous paper 10 to a stacker. A pulley 20 of the tractor 14 is rotated via a pulley 90 fixed on an output shaft of the motor 88 and a timing belt 92.

On the other hand, the scuff roller 80 is rotated by the motor 88 via the pulley 90 fixed on the output shaft of the motor 88, the timing belt 94, the pulley 86, the one-way clutch 96 and the shaft 84. The continuous paper 10 is held between the scuff roller 80 and a pinch roller 82.

A detailed configuration and operation of the one-way clutch 96 is explained with reference to FIG. 3.

Figure 3A:
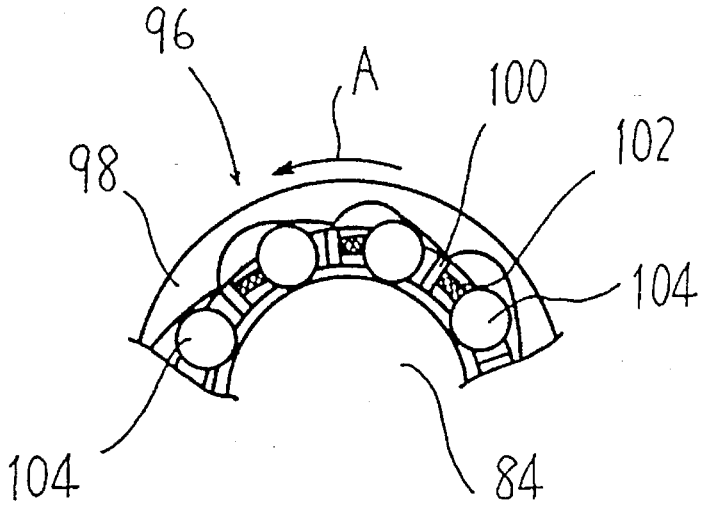
FIGS. 3(A) and 3(B) are diagrams explaining operations of a one-way clutch.
Figure 3B:
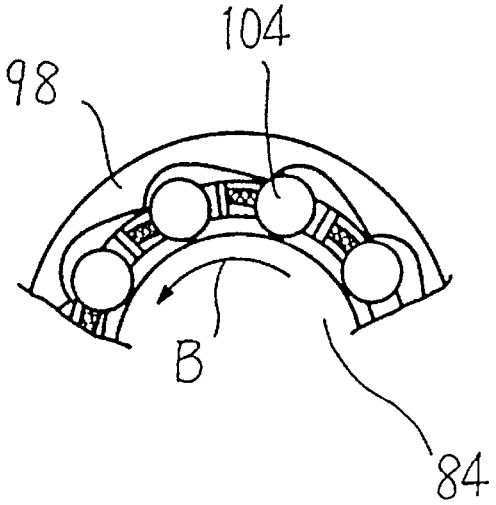

FIG. 3(A) shows a diagram explaining operations of the one-way clutch 96 during transmission of a driving force. FIG. 3(B) shows a diagram explaining operations of the one-way clutch 96 during non-transmission of a driving force. In FIG. 3(A), an outer ring 98 of the one-way clutch 96 is fitted to the pulley 86. When the pulley 86 is rotated by the motor 88 in a direction indicated by an arrow mark A, a roller 104 moves to a position engaging with a cam surface formed at an internal surface of the outer ring 98 due to a spring effect of a metal spring 102 supported by a holding member 100. The roller 104 applies a wedge effect between the cam surface of the outer ring 98 and the external circumferential surface of the shaft 84, and thereby the shaft 84 is rotatably driven in the same direction as the outer ring 98.

Meanwhile, in FIG. 3(B), when driving of the motor 88 stops, rotation of the outer ring 98 also stops, but rotation of the shaft 84 is continued due to its inertia. Therefore, the roller 104 is separated from the cam surface of the outer ring 98. As a result, the scuff roller 80 rotates without any load together with the shaft 84 for the pulley 86.

Next, operation of the image forming apparatus of the present invention during stoppage of a printing operation will be explained in the following. During stoppage of the printing operation, the MPU 71 (not illustrated in FIG. 2) sends, as in the case of the first embodiment explained previously, a driving pulse to a pulse motor 44 to move the transfer guide means 26 to the separating position from the transfer position. Simultaneously, the MPU 71 controls a motor 88 to start deceleration thereof and stops the operation after a predetermined period. That is, the MPU 71 controls the motor 88 to stop the operation when a scoring line of the continuous paper 10 has moved a distance of about ½ inch from the transfer position.

Meanwhile, after the motor 88 has already stopped operation, the scuff roller 80 continues rotation with a rotating inertia of the scuff roller 80 itself. Rotation of the scuff roller 80 imparts tension to the continuous paper 10 since the tractor 14 has already stopped feeding of the continuous paper 10. Thereby, the continuous paper 10 can be separated quickly and accurately from the photosensitive drum 2 and loosening of the continuous paper can also be reliably eliminated.

In each embodiment explained above, a photosensitive drum has been used as the toner carrying member, but the present invention is not limited thereto and, instead, an endless photosensitive belt, for instance, may be used. Moreover, in the case of introducing an electrostatic recording system, a dielectric material drum or dielectric material belt may be employed as the toner carrying member.

As explained above, the first and second embodiments provide an effect that the continuous paper can be separated quickly and accurately from the toner carrying member, by a device of simplified configuration, when the printing operation is stopped. Moreover, the image forming apparatus of these embodiments does not require a transfer guide means which equalizes a transfer route length of the continuous paper during separation and transfer thereof, thereby simplifying the configuration.

In the configuration using a driving source of the transfer means indicated in the second embodiment in common, a cost of an image forming apparatus can be reduced while further simplifying the mechanism.

Figure 4:
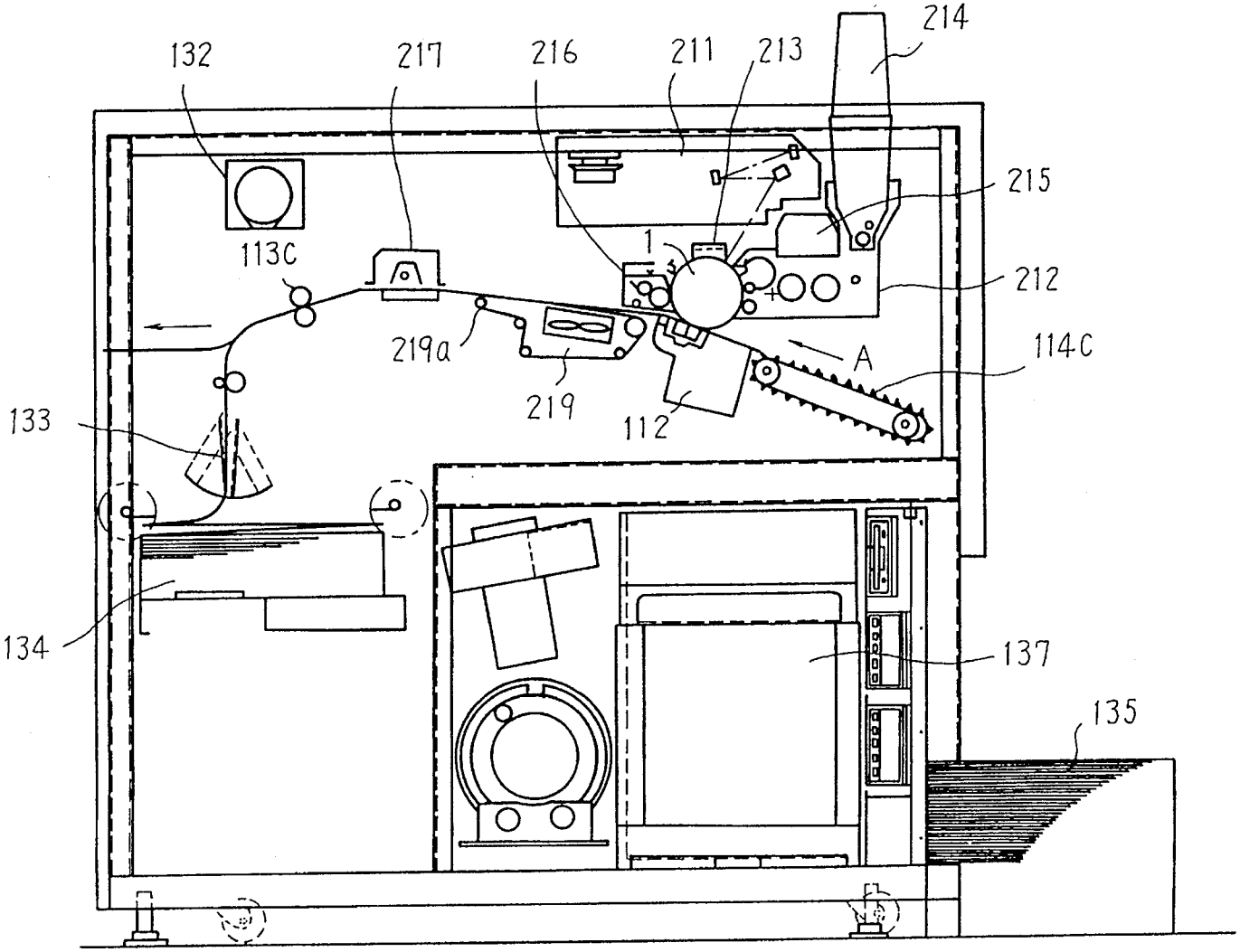
FIG. 4 shows a configuration of a printer apparatus to which a third embodiment of the present invention is applied.

Next, a third embodiment of the present invention will be explained with reference to the accompanying drawings. FIG. 4 to FIG. 9 are diagrams for explaining the third embodiment. FIG. 4 is a diagram illustrating a configuration of a printer apparatus to which the third embodiment is applied.

As shown in FIG. 4, a printer apparatus comprises a photosensitive drum 1 having an a-Si photosensitive layer, an optical means 211, a developing unit 212, a precharger 213, a toner cartridge 214, a developer cartridge 215, a tractor 114*c*, a transfer guide mechanism 112 corresponding to the transfer guide means 120, a cleaner 216, a suction feeder 219, a flash fusing means 217, a scuff roller 113*c*, a desmoking box 132, a swinger 133, a stacker 134, a control unit 137 for controlling the printer apparatus and a paper feeder 135.

The suction feeder 219 is used for automatically loading the continuous paper 10 and is always stopped in drive after completion of an automatic loading operation. The continuous paper 10 is fed to the tractor 114*c* and the scuff roller 113*c* along a curved route formed by the tractor 114*c*, the transfer guide mechanism 112 and the scuff roller 113*c*.

Figure 5:
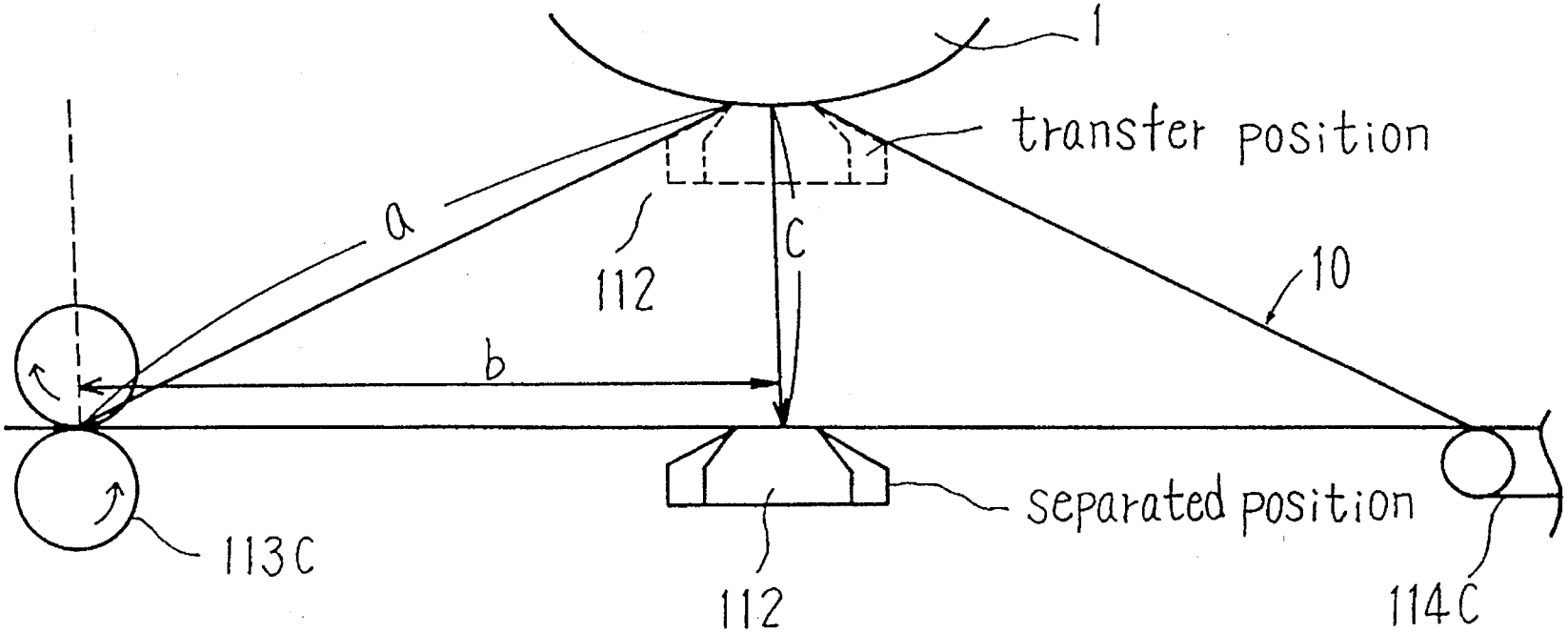
FIG. 5 is a diagram for explaining the loosening amount of a continuous paper.

As illustrated in FIG. 5, in the curved transfer route, if the photosensitive drum 1 is arranged in an upper side of the continuous paper 10, the continuous paper 10 exists at a position where the transfer guide mechanism 112 is located (at a position where the transfer guide mechanism 112 is located, i.e., at the transfer position). The transfer position indicates that the transfer guide mechanism 112 is located at a position indicated by a dotted line in FIG. 5. In this case, the tractor 114*c* and the scuff roller 113*c* are located at a position lower than the position of transfer guide mechanism 112.

In the image forming apparatus configured as explained above, when the transfer guide mechanism 112 is located at a separating position (which indicates that the transfer guide mechanism 112 is located at a position indicated by a solid line in FIG. 5, in order to separate the continuous paper 10 from the photosensitive drum 1) the continuous paper 10 is loosened. Here, a loosening amount z of the continuous paper can be obtained in the following manner.

First, a loosening amount x, of the portion of the continuous paper 10 between the transfer guide mechanism 112 and the scuff roller 113*c*, can be determined by a formula a–b, wherein: "a" defines a route length of the continuous paper, extended over the scuff roller 113*c* and the transfer guide mechanism 112, when the paper 10 closely contacts with the photosensitive drum 1 as shown in FIG. 5 and "b" defines a route length of the paper 10 extended between the scuff roller 113*c* and the transfer guide mechanism 112, when the transfer guide mechanism 112 is located at a stand-by position (separating position).

The route length "a" is expressed by the following formula, wherein a moving distance of the transfer guide mechanism 112, for moving to the contact position (transfer position) from the separating position, is defined as "c".

$$a = \sqrt{(b2 + c2)}$$

On the other hand, a loosening amount "y" of the continuous paper 10, extended between the transfer guide mechanism 112 and the tractor 114*c*, can also be obtained in the same manner as explained above.

Therefore, the loosening amount "z" of the continuous paper can be obtained by adding the loosening amount "y" to the loosening amount "x".

The transfer route length of the continuous paper 10 varies, between a sprocket located at the extreme left end position among a plurality of sprockets of the tractor 114*c*, and a guide roller 219*a* located at the extreme left end position of the suction feeder 219, depending on a position of the transfer guide mechanism 112. The transfer route length of the continuous paper 10 becomes the shortest when the transfer guide mechanism 112 is located at the separating position and becomes the longest when it is located at the transfer position.

Figure 6:
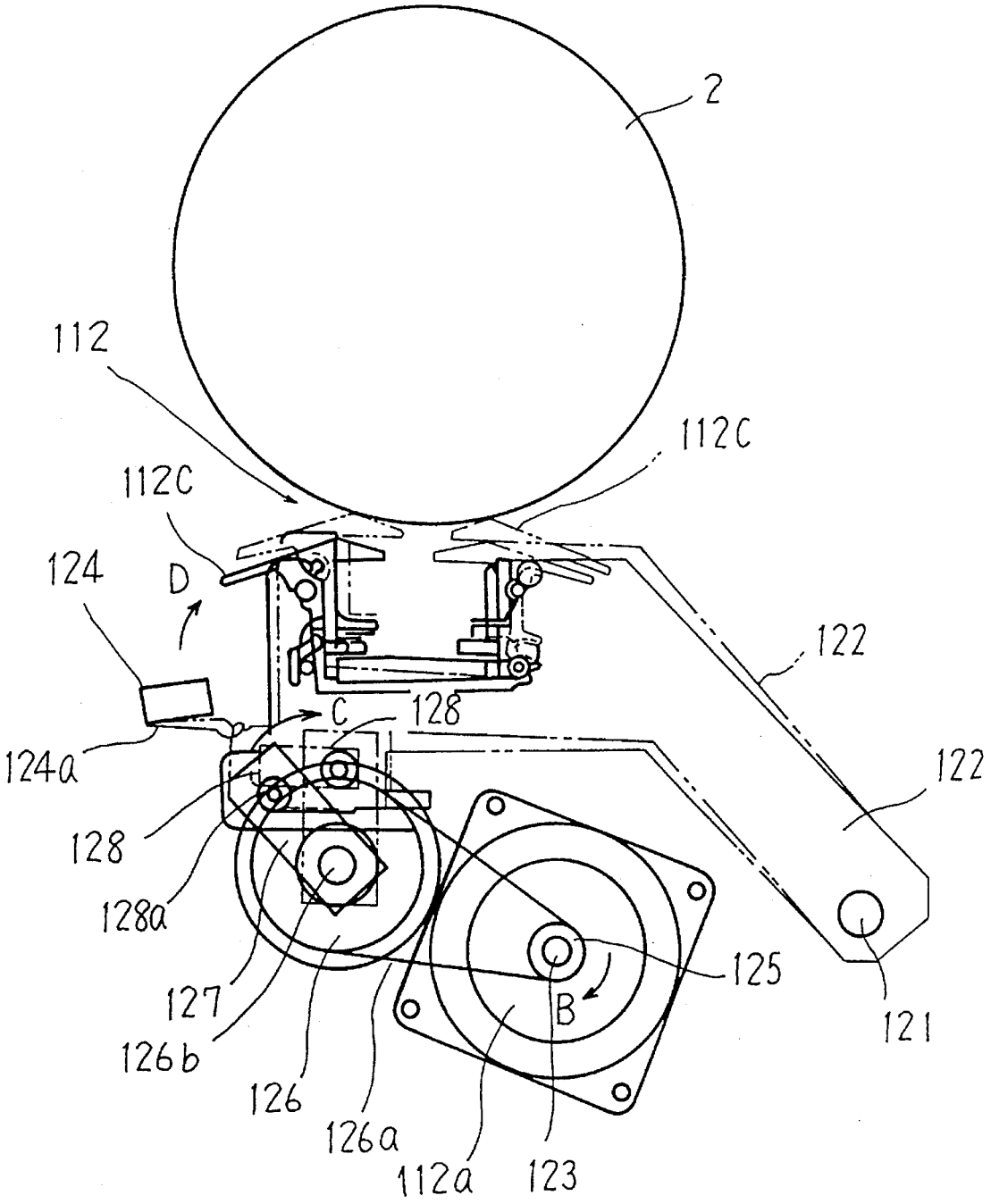
FIG. 6 shows a transfer guide means which can be applied to the printer apparatus shown in FIG. 4.

FIG. 6 illustrates a transfer guide mechanism which may be applied to the printer apparatus of FIG. 4. As shown in FIG. 6, the transfer guide mechanism 112 comprises a fulcrum shaft 121, a side plate 122 of which one end is rotatably supported by the fulcrum shaft 121, a transfer guide plate 112*c* fixed at an upper end of the side plate 122 and a rectangular hole 128 formed at a lower end of the side plate 122. An upper surface of the transfer guide plate 112*c* is provided on the side plate 122 so that it is opposed to the photosensitive drum 2. The side plate 122 holds a transfer charger (not illustrated) between a couple of transfer guide plates 112*c*.

Moreover, the printer frame (not illustrated) at a lower side of the side plate 122 is provided with a transfer guide motor 112*a* configured as a stepping motor. A motor shaft 123 of the transfer guide motor 112*a* supports a pulley 125. A timing belt 126*a* engaging with the pulley 125 transfers a rotating force of the transfer guide motor 112*a* to the pulley 126. One end of a link 127 is fixed to the shaft 126*b* of the pulley 126. The shaft 126*b* of the pulley 126 is rotatably supported by the printer frame (not illustrated). The link 127 supports a bearing 128*a* at the other end thereof. This bearing 128*a* is slidably engaged in the rectangular hole 128 of the side plate 122. An outer diameter of the bearing 128*a* is set a little shorter than a short side length of the rectangular hole 128.

The short side surface in the right side of the rectangular hole 128 works as a mechanical stopper of the bearing 128*a*. When the transfer guide motor 112*a* rotates without control, the stopper regulates movement of the transfer guide mechanism 112 and prevents collision between the transfer guide mechanism 112 and the photosensitive drum 2.

A sensor 124 is provided at a proximity position in a left side of the side plate 122. The sensor 124 is arranged so that an actuator 124*a* of the sensor 124 operates in engagement with an end portion of the side plate 122, immediately after the end portion of the side plate 122 moves downward from the separating position. After the actuator 124*a* has operated, when the transfer guide motor 112*a* has been driven for a predetermined number of steps, the transfer guide mechanism 112 is located at the transfer position.

Here, the length of a long side of the rectangular hole 128 is set so that even if a number of driving pulses more than the predetermined number of steps are given to the transfer guide motor 112*a*, the bearing 128*a* collides with the stopper of the rectangular hole 128 before the transfer guide mechanism 112 collides with the photosensitive drum 2.

Figure 7:
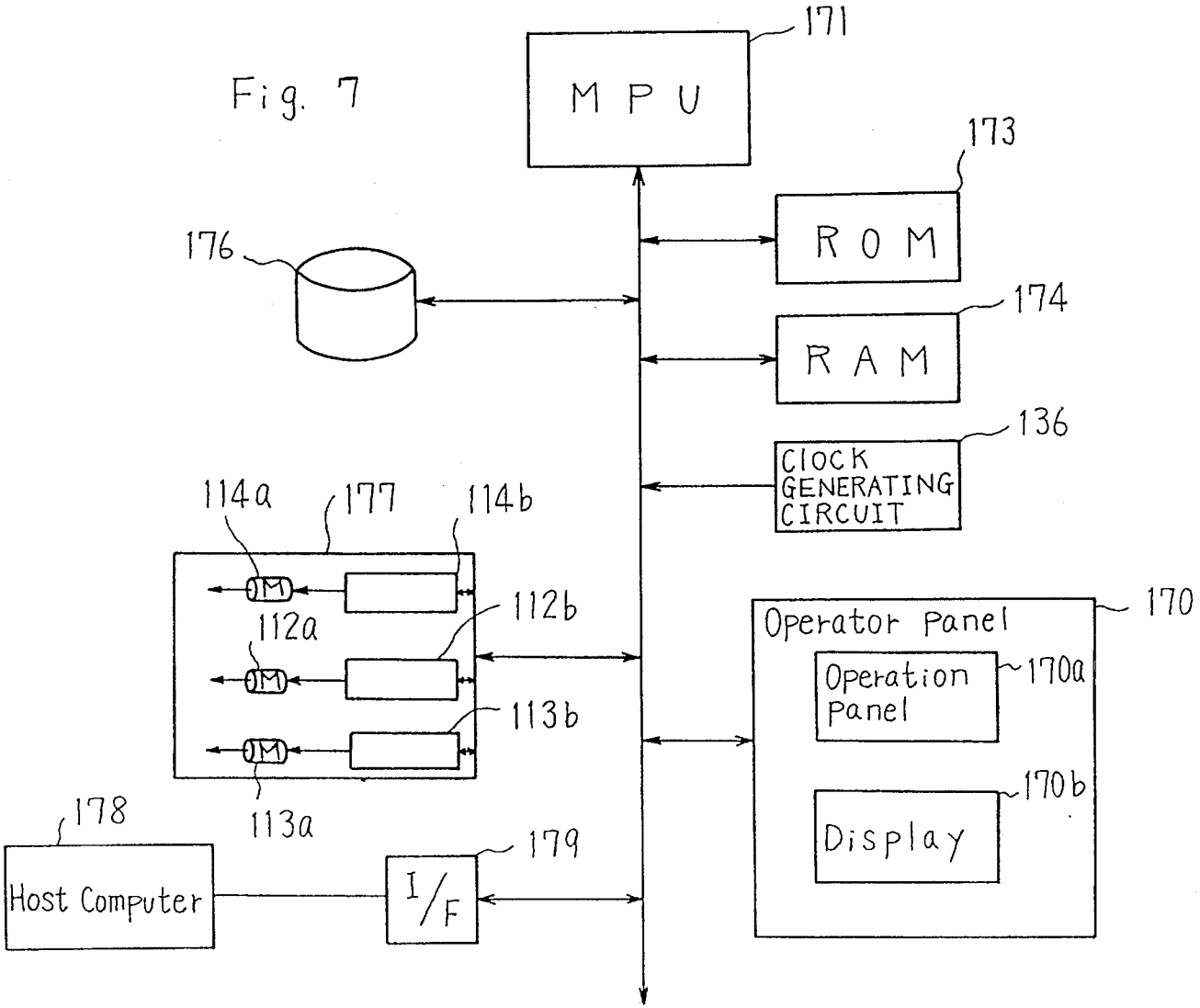
FIG. 7 is a block diagram illustrating a system configuration of the printer apparatus shown in FIG. 4.

FIG. 7 is a block diagram illustrating a system configuration of the printer apparatus of FIG. 4. In FIG. 7, a printer engine 177 comprises a transfer guide motor 112*a* for moving the transfer guide mechanism 112, a motor controller 112*b* for controlling the transfer guide motor 112*a*, a front side feeding motor 114*a* for driving a tractor 114*c*, a motor controller 114*b* for controlling the front side feeding motor 114*a*, a back side feeding motor 113*a* for driving a scuff roller 113*c* and a motor controller 113*b* for controlling the back side feeding motor 113*a*.

The MPU 171 executes various control operations for the printer engine 177 or the like using a ROM 173 storing various programs and a RAM 174 which realizes writing and reading of various data. The printer engine 177, a host computer 178 connected through an interface 179, an operator panel 170 including an operation panel 170*a* and a display 170*b*, and a file 176 storing the data for printing, or the printed data, are connected with the MPU 171, etc. via an internal bus. The operation panel 170*a* is provided to enable an operator to input a printing start instruction and a power-on instruction, etc. The display 170*b* displays operating conditions of the printer apparatus. The host computer 178 transfers data to the printer apparatus via the interface 179 and also issues various printing instructions.

Figure 8:
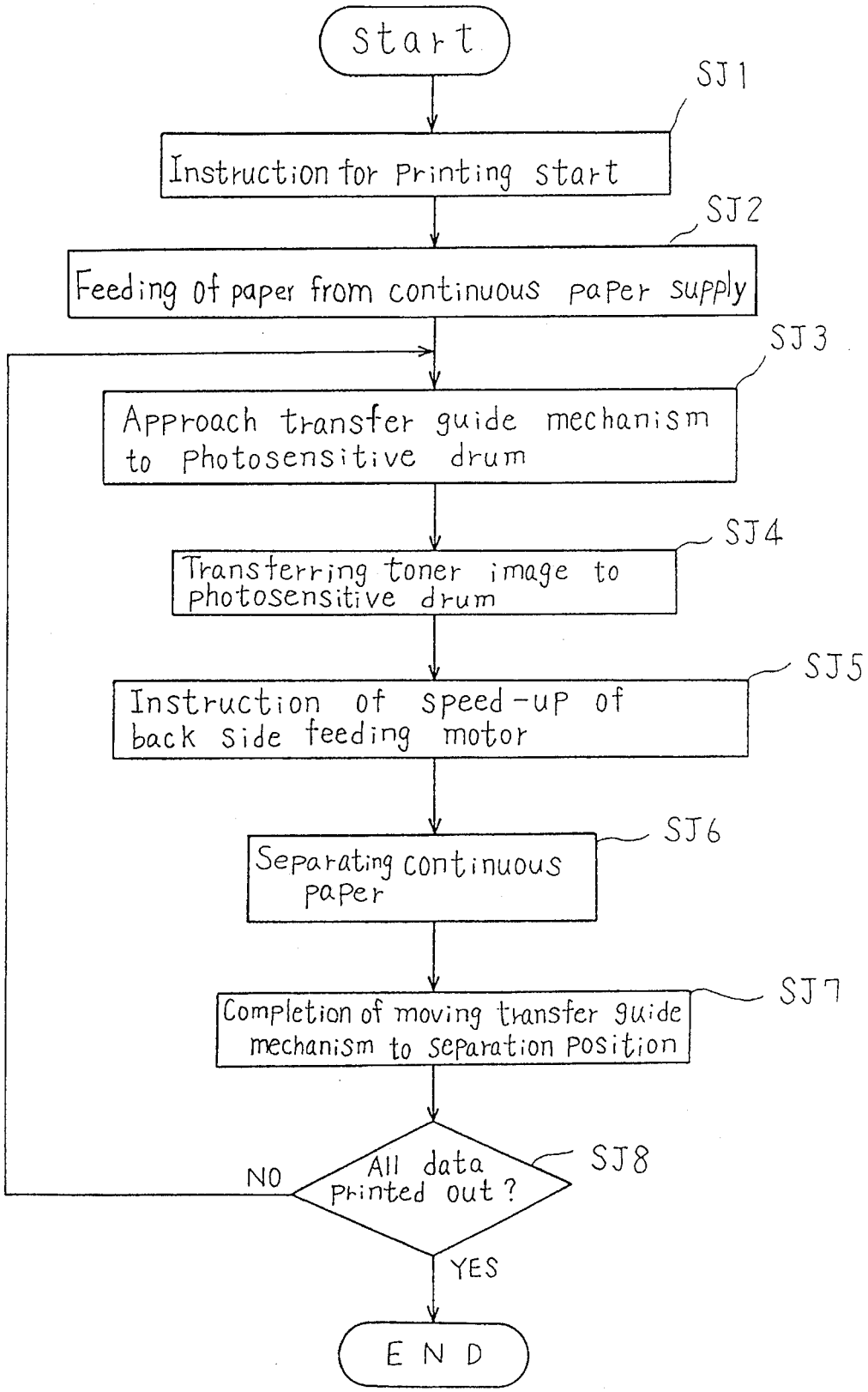
FIG. 8 shows an operation flow of the printer apparatus shown in FIG. 4.

Operations of the printer apparatus shown in FIG. 4 will be explained with reference to FIG. 8. FIG. 8 illustrates an operation flowchart of the printer apparatus shown in FIG. 4.

① (Step SJ1)

When an instruction for printing start is inputted from the host computer 178 or the operation panel 170*a*, the MPU 171 causes the printer engine 177 to start a printing operation depending on the program stored in the ROM 173.

② (Step SJ2)

The MPU 171 issues an instruction to the motor controllers 114*b*, 113*b* in order to drive the tractor 114*c* and the scuff roller 113*c*. Thereby, transfer of continuous paper 10 in a direction indicated by an arrow mark A is started and the continuous paper 10 is sequentially supplied from a paper feeding section 135.

Meanwhile, the MPU 171 executes a toner image forming operation by a process section including the photosensitive drum 1. That is, during a rotating operation of the photosensitive drum 1, a cleaning operation by the cleaner 216, a precharging operation by the precharger 213, a laser beam irradiating operation in accordance with the printing information by the optical section 211 and a developing operation by the developing section 212 are executed. Thereby, a toner image is formed on the photosensitive drum 1.

③ (Step SJ3)

Next, the MPU 171 instructs the motor controller 112*b* to move the transfer guide plate 112*c* to the transfer position in synchronization with an approach of the toner image (on the photosensitive drum 1) to the transfer section. The motor controller 112*b* drives the transfer guide motor 112*a* to locate the transfer guide plate 112*c* to the transfer position.

In this case, the transfer guide motor 112*a* is first driven in a direction indicated by an arrow mark B. The rotating force of the transfer guide motor 112*a* is transmitted to the link 127 via the timing belt 126*a* and the pulley 126. With the rotating force, the link 127 rotates in a direction of an arrow mark C. With rotation of the link 127, a bearing 128*a* slides to push the upper surface of the rectangular hole 128. Movement of the bearing 128*a* results in rotation of the side plate 122 in a direction of an arrow mark D. Thereby, the transfer guide plate 112*c* moves together with the side plate 122 toward the transfer position.

When the transfer guide plate 112*c* starts to move upward, the sensor 124 detects the start of upward movement of the transfer guide plate 112*c* via the side plate 122 and outputs a detection signal. The MPU 171 provides a number of steps, required by the transfer guide plate 112*c* to reach the transfer position, to the motor controller 112*b* with reference to the detection signal from the sensor 124. The motor controller 112*b* supplies driving pulses corresponding to the number of steps given to the transfer guide motor 112*a*.

When the driving pulse has been outputted, the transfer guide plate 112*c* is located at the transfer position and the continuous paper 10 is closely contacted with the photosensitive drum 1. During this time, a gap between an upper surface of the transfer guide plate 112*c* and the photosensitive drum 1 is set to a predetermined value.

④ (Step SJ4)

Under the conditions explained above, a toner image on the photosensitive drum 1 is transferred to the continuous paper 10.

⑤ (Step SJ5)

Next, after transfer of the toner image on the photosensitive drum 1 onto the continuous paper 10, the MPU 171 instructs the motor controller 113*b* to raise the rotating velocity of the scuff roller 113*c* in synchronization with the arrival of the scoring line of the continuous paper 10. The MPU 171 determines the arrival of the scoring line on the continuous paper 10 from length information between the scoring line on the continuous paper 10 and an amount of rotation of the front side feeding motor 114*a*. The motor controller 113*b* increases a number of rotations per unit time of the scuff roller 113*c* up to about 1.5 times, during a predetermined period. The continuous paper 10 is thus given tension by increasing the number of rotations of the scuff roller 113*c*.

⑥ (Step SJ6)

The MPU 171 outputs an instruction to the motor controller 113*b* and simultaneously instructs the motor controller 112*b* to initiate the separating operation of the transfer guide plate 112*c*. The motor controller 112*b* drives the transfer guide motor 112*a* in a direction opposed to the direction of the arrow mark B. Thereby, the transfer guide plate 112*c* moves toward the separating position from the transfer position. With movement of the transfer guide plate 112*c*, the continuous paper 10, closely contacted with the photosensitive drum 1, is forced to be separated from the photosensitive drum 1 with the given tension.

⑦ (Step SJ7)

When the motor controller 112*b* gives driving pulses required to move the transfer guide plate 112*c* to the separating position from the transfer position, the transfer guide motor 112*a* moves the transfer guide plate 112*c* to the separating position. During this time, the continuous paper 10 is separated from the photosensitive drum 1 without loosening thereof due to tension given from the feeding force of the scuff roller 113*c*. Even though movement of the transfer guide plate 112*c* to the separating position is executed at a high speed, the continuous paper 10 can follow the movement of the transfer guide plate 112*c*. Therefore, the continuous paper 10 is moved to the position perfectly matching with the shortest route formed by the tractor 114*c*, the transfer guide plate 112*c* and the guide roller 219*a*.

⑧ (Step SJ8)

After the steps SJ1 to SJ7 are executed, the MPU 171 determines for all data whether or not formation of toner image, transfer of toner image onto the continuous paper 10, fusing of toner image on the continuous paper 10, and exhaust processing of the continuous paper 10 into the stacker 134 is conducted. If processing of all data is not yet completed, the operation returns to the step SJ3. Meanwhile, when the processing for all data is completed, the printing is also considered as being completed, and processing waits for an instruction for the next printing operation.

Figure 9:
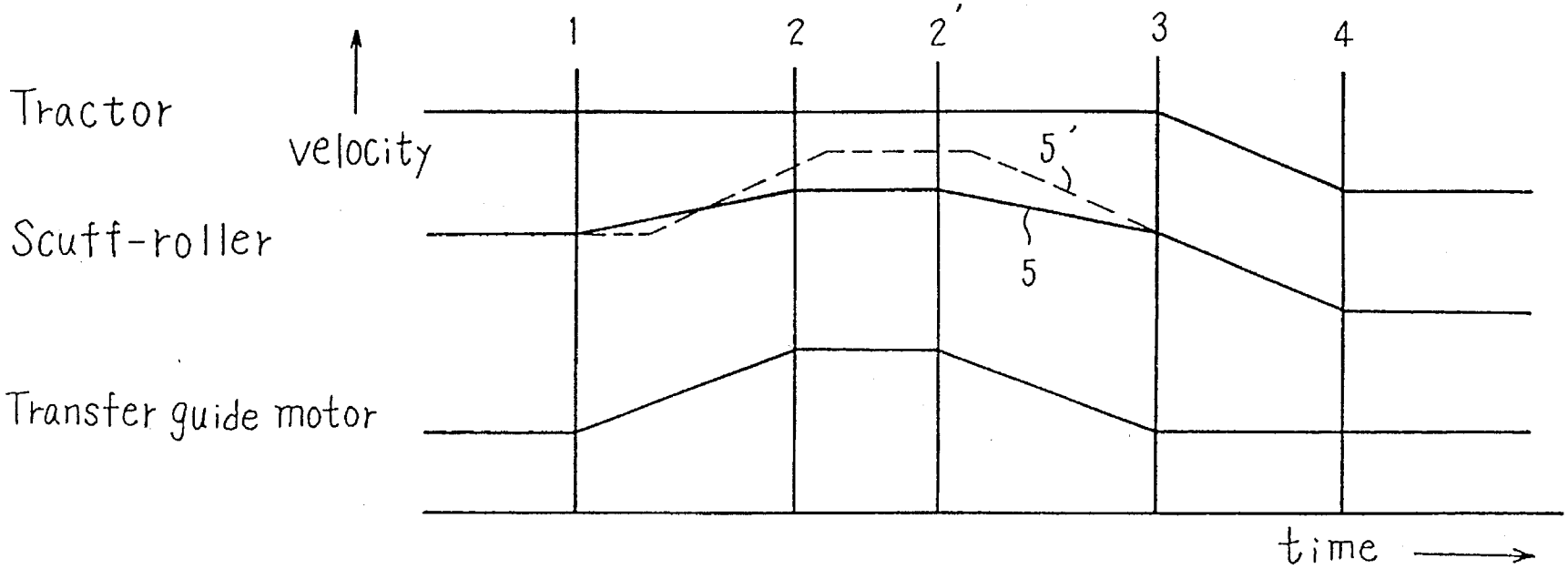
FIG. 9 shows an operation timechart of the printer apparatus shown in FIG. 4.

FIG. 9 is an operation timechart of the printer apparatus as shown in FIG. 4. FIG. 9 shows a change in status for a feeding velocity of the tractor 114*c*, a velocity of the scuff roller 113*c* and a velocity of the transfer guide motor 112*a* when the continuous paper 10 is separated from the photosensitive drum 1.

As shown in FIG. 9, the MPU 171 instructs the motor controller 112*b* to start movement of the transfer guide mechanism 112 to the separating position at the time ①, for starting the separating operation for the continuous paper 10 in synchronization with a clock signal generated by a clock oscillator 136. The motor controller 113*b* controls the scuff roller 113*c* to raise a number of rotations from the time ①.

The motor controller 113*b* controls a back side feeding motor 113*a* so that the speed of rotation of the scuff roller 113*c* becomes a maximum at the time ② where a number of rotations of the transfer guide motor 112*a* of the transfer guide mechanism 112 becomes maximum. Moreover, the motor controller 113*b* controls the back side feeding motor 113*a* so that deceleration of the scuff roller 113*c* starts at the time ②' when deceleration of the transfer guide motor 112*a* is started. As explained above, since the acceleration end time of the transfer guide motor 112*a* matches with that of the back side feeding motor 113*a*, and the deceleration start time of the transfer guide motor 112*a* matches with that of the back side feeding motor 113*a*, respectively, it is never detected that excessive tension is given to the continuous paper 10 and loosening is generated on the continuous paper 10.

Moreover, the motor controller 113*b* controls the back side feeding motor 113*a* so that the rotation speed of the scuff roller 113*c* becomes equal to the transfer velocity of the continuous paper, from the tractor 114*c*, in synchronization with the time ③ when driving of the transfer guide motor 112*a* by the motor controller 112*b* is completed.

The motor controllers 113*b*, 114*b* respectively start simultaneous deceleration of the front side feeding motor 114*a* and the back side feeding motor 113*a*. These motor controllers 113*b*, 114*b* control the front side feeding motor 114*a* and the back side feeding motor 113*a* so that the front side feeding motor 114*a* and the back side feeding motor 113*a* simultaneously stop at the time ④.

As is understood from the above explanation, since the transfer velocity of the scuff roller 113*c* is increased more than the ordinary velocity when the continuous paper 10 is moved to the separating position from the transfer position, tension is given to the paper 10 and thereby the continuous paper 10 can be quickly and accurately become separated from the photosensitive drum 1.

Next, an example which eliminates loosening of the continuous paper 10 by lowering a feeding velocity of the tractor 114*c* in the printer apparatus shown in FIG. 4 will be explained in the following.

Figure 10:
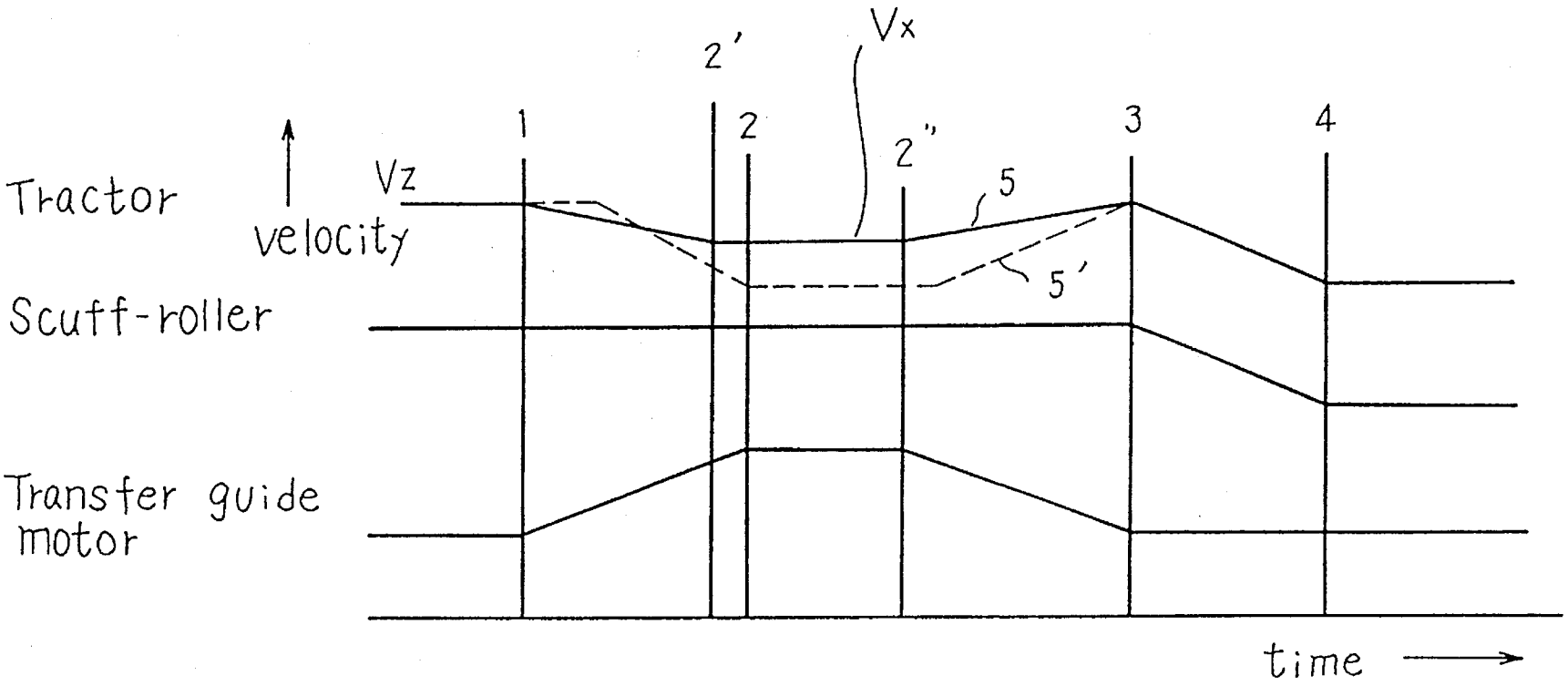
FIG. 10 shows another example of an operation timechart of the printer apparatus shown in FIG. 4.

FIG. 10 illustrates another example of the operation timechart of the printer apparatus shown in FIG. 4. FIG. 10 shows, as in the case of FIG. 9, a change in status of a transfer velocity of the tractor 114*c*, a rotating velocity of the scuff roller 113*c* and a velocity of the transfer guide motor 112*a* when the continuous paper 10 is separated from the photosensitive drum 1. FIG. 10 is different from FIG. 9 in that change of transfer velocity of the continuous paper of the tractor 114*c* is controlled by interlocking with the separating operation of the continuous paper.

As shown in FIG. 10, the MPU 171 instructs the motor controller 112*b* to start separation of the transfer guide mechanism 112 in synchronization with a clock signal from the clock oscillator 136 at the time ① where a separating operation of the continuous paper 10 is started. In this case, a feeding velocity of tractor 114*c* is controlled to a velocity $V_z$ by the motor controller 114*b*. The motor controller 114*b* starts a decrease in a number of rotations of the front side feeding motor 114*a* from this time ①.

The motor controller 114*b* controls the front side feeding motor 114*a* so that the rotating velocity of the front side feeding motor 114*a* becomes constant (tractor velocity $V_x<V_z$) at the time ②' a little before the time ② where the number of rotations of the transfer guide motor 112*a* of the transfer guide mechanism 112 becomes maximum. In this case, since a rotation velocity of the scuff roller 113*c* is kept constant, the continuous paper 10 is given tension. Therefore, the continuous paper 10 follows the separating operation of the transfer guide plate 112*c* under a condition that the continuous paper 10 is in contact with an upper surface of the transfer guide plate 112*c*.

A motor velocity controller 114*b* starts an increase of a rotating velocity of the front side feeding motor 114*a* at the time ②". Moreover, the motor velocity controller 112*b* simultaneously starts a decrease of the rotating velocity of the transfer guide motor 112*a*.

The motor velocity controller 114*b* controls the rotating velocity of the front side feeding motor 114*a* to $V_z$ at the time ③. Moreover, the motor velocity controller 112*b* simultaneously controls the rotating velocity of the transfer guide motor 112*a* to zero at the time ③. Here, the period between the time ① and the time ③ corresponds to the time required for moving to the separating position.

As is understood from the above explanation, the transfer velocity of the scuff roller 113*c* becomes relatively faster than the transfer velocity of the tractor 114*c* while the transfer guide motor 112*a* moves the transfer guide plate 112*c* to the separating position from the transfer position. Thereby, the continuous paper 10 is always given tension during movement of the transfer guide plate 112*c*.

Finally, the motor velocity controller 114*b* and the motor velocity controller 113*b* start deceleration of the front side feeding motor 114*a* and the back side feeding motor 113*a* at the time ③ and also control rotation of both front side feeding motor 114*a* and back side feeding motor 113*a* to zero at the time ④.

Next, an example which eliminates loosening of the continuous paper 10 in the printer apparatus of FIG. 4, on the basis of the transfer velocity information indicating change of transfer velocity of the paper 10 and/or paper quality information of the paper 10, will be explained in the following.

Figure 11:
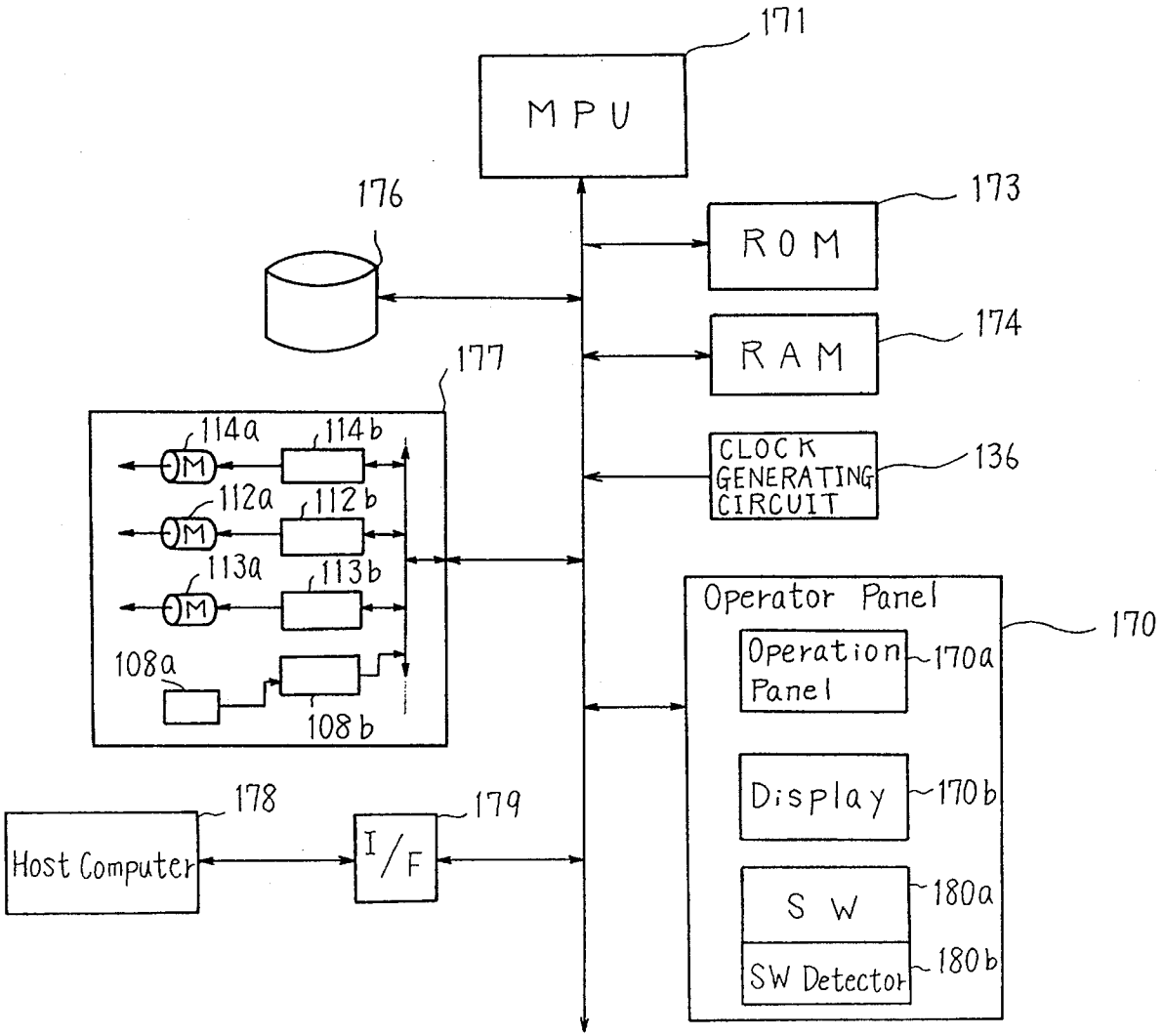
FIG. 11 is a block diagram illustrating a system configuration of a printer apparatus.

FIG. 11 is a block diagram illustrating another system configuration of a printer apparatus. As shown in FIG. 11, the printer apparatus is provided with a transfer velocity detector 108 for detecting a transfer velocity of the continuous paper. In addition, the printer apparatus provides an operator switch 180*a* for inputting paper quality information of the continuous paper and a switch detector 180*b* in the operator panel 170.

The velocity detector 108 comprises a transfer velocity sensor 108*a* and a sensor detector 108*b*. The transfer velocity sensor 108*a* is arranged, within the printer apparatus shown in FIG. 4, at a position being in contact with the continuous paper 10 within a region between the tractor 114*c* and photosensitive drum 1. The transfer velocity sensor 108*a* is a detector, for example, as disclosed in the Japanese Patent Laid-Open Patent No. SHO 52-32707 or 55-111353. These detectors comprise a rotating roller which is in contact with the continuous paper and a detecting element having a light emitting element arranged to face one surface of the rotating roller and a photosensitive element arranged to face the other surface thereof, for detecting a plurality of holes formed on the rotating roller in a predetermined pitch.

Figure 12:
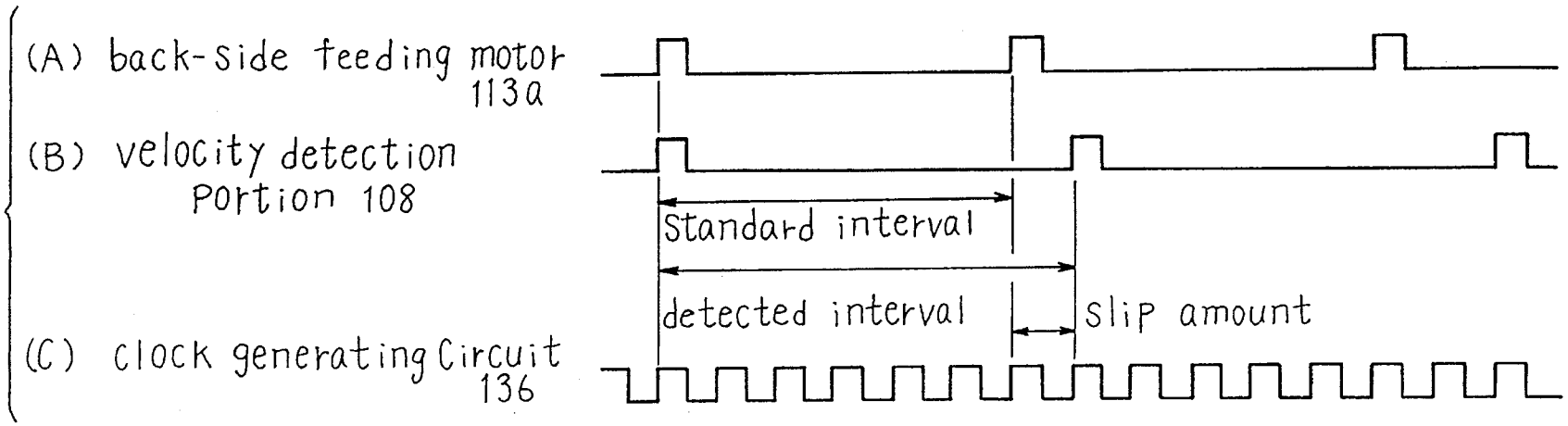
FIG. 12 shows an operation timechart of the printer apparatus shown in FIG. 11.

The MPU 171 compares the period of the rotating pulse ((B) of FIG. 12) outputted from the sensor detector 108*b* and the period of the rotating pulse ((A) of FIG. 12) representing a reference transfer velocity of the continuous paper 10. The MPU 171 detects a slip condition of the continuous paper 10 from differences of these periods. The MPU 171 further calculates, on the basis of the information obtained from a result of such comparison or on the basis of paper quality information inputted from the operator switch 180*a*, the drive timing or transfer velocity of the front side feeding motor 114*a*, the back side feeding motor 113*a* and the transfer guide motor 112*a*. Here, paper quality of the continuous paper 10 means properties such as thickness, smoothness and weight thereof. Moreover, as a means for inputting the paper quality information, a host computer such as a personal computer, for giving a paper quality information to the printer apparatus as a command information, can be used as well as a key switch provided on the operator panel of the printer apparatus.

The basic system configuration of the printer apparatus shown in FIG. 11 is almost similar to the basic system configuration shown in FIG. 7. The difference between the basic system configuration of the printer apparatus shown in FIG. 11 and that shown in FIG. 7 is that a velocity detector 108, connected with the MPU 171 via a bus and an operator switch 180*a*, and switch detector 180*b*, provided within the operator panel 170 are additionally provided for the basic system configuration shown in FIG. 7.

Operation of the printer apparatus shown in FIG. 11 will be explained also with reference to FIG. 12, FIG. 9 and FIG. 10. FIG. 12 illustrates an operation timechart of the printer apparatus shown in FIG. 11.

First, the MPU 171 detects the period of the pulse signal ((A) of FIG. 12) outputted from the sensor (not illustrated) for detecting the rotating velocity of the front side feeding motor 114*a*. The period corresponds to a rotating velocity of the front side feeding motor 114*a*. The MPU 171 counts up a number of clock signals X generated by the clock oscillator 136 between two continuous pulse signals (A).

Meanwhile, the MPU 171 detects the period of pulse signal ((B) of FIG. 12) outputted from the velocity detector 108. The period can be obtained from the MPU 171 by counting a number of clock signals Y generated by the clock oscillator 136 during continuous two pulse signals (B).

The MPU 171 calculates a difference between the number of clock signals X and the number of clock signals Y. A value of the difference obtained corresponds to an amount of slip or an amount of loosening of the continuous paper.

The MPU 171 instructs an increase of the rotating velocity of the back side feeding motor 113*a* via the motor controller 113*b* depending on the amount of slip obtained. The motor controller 113*b* controls the back side feeding motor 113*a* depending on such instruction to increase the rotating velocity thereof. Thereby, the continuous paper 10 is always transferred without a slip condition. That is, the MPU 171 controls the back side feeding motor 113*a* to eliminate the detected loosening on the occasion of movement of the transfer guide plate 112*c* to the separating position from the transfer position.

The MPU 171 can eliminate loosening of the continuous paper 10 by lowering the transfer velocity of the tractor 114*c* depending on an output of the velocity detector 108. Moreover, the MPU 171 can eliminate loosening of the continuous paper 10 by controlling both motor controllers 114*b* and 113*b*, so that a relative difference is generated between the transfer velocity of the tractor 114*c* and that of the scuff roller 113*c*, depending upon an output of the velocity detector 108.

A force required to eliminate loosening of the continuous paper changes depending upon a degree of slip of the continuous paper. For instance, if a degree of slip is high, a large force must be applied to the continuous paper. When an excessive force, in comparison with the degree of slip, is applied to the continuous paper, the continuous paper is sheared. Therefore, only a reasonable force must be applied to the continuous paper. On the other hand, when a degree of slip of the continuous paper is low, the force to be applied to the continuous paper may be small.

A change of force applied to the continuous paper by a front side feeding member and a back side feeding member can be realized by changing an absolute value of the transfer velocity (acceleration) of the continuous paper. Change of acceleration of the continuous paper can be realized by changing a relative transfer velocity difference between the transfer velocity of the front side feeding member and that of the back side feeding member, or changing the timing for increase or decrease of the transfer velocity, or changing the time for increasing or decreasing a transfer velocity of the continuous paper.

The MPU 171 can also execute a detection of a jam of the continuous paper 10, during a transfer operation of a toner image on the continuous paper 10, using a detected output of the velocity detector 108. Moreover, the MPU 171 can also use a detected output of the velocity detector 108 only during the separating operation of the continuous paper.

The MPU 171 obtains paper quality information inputted from the operator switch 180*a* via the switch detector 180*b*. The MPU 171 also detects a kind of paper 10 loaded on the printer apparatus on the basis of the detected output of the switch detector 180*b*. The MPU 171 also calculates the drive timing or a rotating velocity of the back side feeding motor 113*a* on the basis of the types of paper supplied by the continuous paper 10.

In the case where the continuous paper being set is a continuous paper having a smooth surface, a continuous paper which is thick and heavy or a continuous paper which is thick and low in flexibility, a large amount of energy is required to transfer the paper, resulting in a large load on the scuff roller 113*c*. Therefore, in order to reliably eliminate loosening of the continuous paper, an absolute value of the acceleration applied to the scuff roller 113*c* must be increased.

For example, when a thick continuous paper or a paper having a smooth surface is used, it becomes difficult, like the case where a degree of slip is high, to transfer paper by the front side feeding member or the back side feeding member, and thereby the load of each transfer member becomes large. Since such a continuous paper is resistive to sudden acceleration, the transfer velocity can be increased or decreased abruptly by comparatively making a large rate of increase or decrease of the transfer velocity of the continuous paper, or comparatively delaying the timing for increasing or decreasing the transfer velocity.

On the contrary, when a thin continuous paper or a continuous paper having a rough surface is used, a force required for each transfer member may be small. Therefore, the continuous paper is not required to be accelerated suddenly. Loosening of the continuous paper is never generated by changing a value of the transfer velocity of the paper depending upon the paper quality information.

Where the MPU 171 decided, on the basis of the detected output of the switch detector 180*b*, that the continuous paper of the type explained above is being set on the printer apparatus, the MPU 171 changes a rotating velocity curve of the scuff roller 113*c* when the paper 10 is moved to the separating position from the transfer position. That is, the MPU 171 changes the rotating velocity curve (indicated by the solid line ⑤ in FIG. 9) of the scuff roller 113*c* obtained by using the paper of the ordinary type into the rotating velocity curve (indicated by the dotted line ⑤' in FIG. 9) for the thick continuous paper.

In the rotating velocity curve for the thick continuous paper, the timing for increasing a number of rotations of the scuff roller 113*c* is delayed and a value of the maximum velocity is increased. Therefore, the acceleration (transferring force) given to the continuous paper 10 by the scuff roller 113*c* is increased.

The transferring force applied to the paper by the scuff roller 113*c* can also be changed by matching the timing for increasing a number of rotations to the time ① and increasing only the maximum velocity value.

When the MPU 171 has decided, on the basis of the detected output of the switch detector 180*b*, that the continuous paper, of the type explained above, is set on the printer apparatus, the velocity curve of the tractor 114*c* may be changed when the continuous paper 10 is moved to the separating position from the transfer position.

Namely, the MPU 171 changes the velocity curve (solid line ⑤ of FIG. 9) of the tractor 114*c* when the continuous paper of the ordinary type is used into the velocity curve (dotted line ⑤' of FIG. 9) when the thick continuous paper is used. In the velocity curve for the thick continuous paper, the timing for lowering the acceleration is delayed from the time ① and the minimum velocity is further lowered.

As is understood from the above explanation, loosening of the continuous paper can be effectively eliminated when the transfer velocity of the scuff roller 113*c* is relatively faster than the transfer velocity of the tractor 114*c*. Therefore, a relative velocity difference between the transfer velocity of the scuff roller 113*c* and that of the tractor 114*c* for eliminating loosening of the continuous paper is not limited to the combination indicated for each embodiment explained above.

That is, such a relative velocity difference is given to satisfy the relationship of $V_r - V_f > 0$, where the circumferential velocity (i.e., the back, or rear, side feeding velocity) of the scuff roller 113*c* is defined as $V_r$ and the transfer velocity (i.e., the front side feeding velocity) of the tractor 114*c* is defined as $V_f$. The relationship indicates that the relative transfer velocity of the continuous paper becomes positive for the transfer direction thereof.

As a controlling method for satisfying the above relationship, ① a decrease of the back side feeding velocity $V_f$ or ② an increase of the front side feeding velocity $V_r$ may be used. Moreover, it is also possible to use both methods, i.e., of decreasing the back side feeding velocity $V_f$ and increasing the front side feeding velocity $V_r$.

In addition, it is also possible to increase the front side transfer velocity $V_f$ and increase the back side transfer velocity $V_f$ by an amount less than the value of the increased front side transfer velocity $V_f$. It is further possible that the front side transfer velocity $V_f$ is decreased and the back side transfer velocity $V_r$ is decreased to a value less than the decreased front side transfer velocity $V_f$.

Moreover, the relative velocity difference can also be obtained by changing the timing for increasing and/or decreasing a value of the transfer velocity. In addition, it may be a change of the time for increasing and/or decreasing the transfer velocity.

As explained above, the continuous paper can be separated quickly and accurately because the relative transfer velocity of the back side feeding member becomes faster on the occasion of separating the continuous paper from the toner carrying member by the transfer guide member.

Furthermore, since the transfer guide mechanism which equalizes the transfer route length of the continuous paper in the transfer operation and the separating operation is no longer required, the transfer guide means can be constituted simply and economically.

Moreover, since the continuous paper is always given tension, loosening of the continuous paper is never generated, a toner image on the continuous paper is never disturbed and a surface of the toner carrying member is never damaged.

What is claimed is:

1. An image forming apparatus which forms images on paper of a continuous paper supply, comprising:

a toner carrying member having a surface carrying a toner image and driven so as to define a first surface velocity and an associated first direction of movement;

transfer guide means for selectively moving the continuous paper to a first position at which the continuous paper is in contact with said toner image carrying surface and is fed at a surface velocity and associated direction of movement respectively corresponding to the first surface velocity and associated first direction of movement of the toner image carrying surface, for transfer thereto of the toner image from the image carrying surface and to a second position at which the continuous paper is separated from said toner image carrying surface;

roller means, provided at a downstream side of said transfer guide means relative to the direction of movement of the paper and rotatable at selectable, different rates defining corresponding and selectable, different feed velocities, for engaging a portion of and thereby feeding the paper; and control means for controlling the rate of rotation of said roller means, at the first position thereof, to a first rotation rate so that the corresponding first feed velocity of said roller means is faster than the surface velocity of said toner carrying surface and, during moving of the paper by said transfer guide means to the second position, to a second rotation rate and corresponding second feed velocity which are greater, respectively, than the first rotation rate and first feed velocity.

2. An image forming apparatus as recited in claim 1, wherein: said transfer guide means moves the continuous paper from the first, transfer position at which the paper contacts said toner carrying member and to the second, separated position at which the continuous paper is displaced from said toner carrying member.

3. An image forming apparatus as recited in claim 2, wherein the first feed velocity of said roller means is greater than the first surface velocity of said toner carrying member.

4. An image forming apparatus as recited in claim 2, further comprising:

feeding means for feeding the continuous paper toward an area between said toner carrying member and said transfer guide means; and a feeding path defined by said feeding means, said transfer guide means and said roller means comprises a curved path.

5. An image forming apparatus as recited in claim 4, wherein said feeding means comprises a tractor.

6. An image forming apparatus as recited in claim 2, further comprising:

a non-contact type fuser, provided in a feeding path formed between said transfer guide means and said roller means.

7. An image forming apparatus as recited in claim 6, wherein:

said non-contact type fuser is a flash fixing apparatus.

8. An image forming apparatus as recited in claim 7, wherein:

said roller means is a scuff roller.

9. An image forming apparatus as recited in claim 8, wherein:

the first feed velocity of said roller means is greater than the surface velocity of said toner carrying member.

10. An image forming apparatus as recited in claim 1, wherein a feeding path defined by said transfer guide means and said roller means comprises a curved path.

11. An image forming apparatus as recited in claim 1, wherein said transfer guide means comprises:

a guide plate moveable between a transfer position and a separated position; and a motor for moving said guide plate.

12. An image forming apparatus as recited in claim 1, wherein the first feeding velocity of the continuous paper supply, as fed by said roller means, is greater than the first surface velocity of said toner carrying member.

13. An image forming apparatus as recited in claim 1, further comprising:

feeding means for feeding the continuous paper supply toward an area between said toner image carrying member and said transfer guide means; and a feeding path defined by said feeding means, said transfer guide means and said roller means comprises a curved path.

14. An image forming apparatus as recited in claim 1, further comprising:

a non-contact type fuser, provided in a feeding path formed between said transfer guide means and said roller means.

15. An image forming apparatus as recited in claim 14, wherein:

said non-contact type fuser is a flash fixing apparatus.

16. An image forming apparatus as recited in claim 15, wherein:

said roller means comprises a scuff roller.

17. An image forming apparatus as recited in claim 16, wherein the first feeding velocity of the paper from the continuous paper supply, as fed by said roller means, is greater than a first surface velocity of said toner carrying member.

18. An image forming apparatus as recited in claim 16, wherein:

said feeding means comprises a tractor.

19. An image forming apparatus as recited in claim 18, wherein a feeding path defined by said tractor, said transfer guide means and said scuff roller comprises a curved path.

20. An image forming apparatus as recited in claim 19, wherein said guide means comprises:

a guide plate moveable between a transfer position and a separated position; and a motor for moving said guide plate.

21. An image forming apparatus which forms images on paper of a continuous paper supply, comprising:

a toner carrying member having a surface carrying a toner image and moveable so as to define a surface velocity and an associated direction of movement;

transfer guide means for selectively moving the continuous paper, in a first time interval, so that the continuous paper is in contact with said toner image carrying surface and the continuous paper is fed at a surface velocity and associated direction of movement respectively corresponding to the surface velocity and associated direction of movement of the toner image carrying surface, for transfer thereto of a toner image from the image carrying surface and, in a second time interval, so as to separate the continuous paper from said toner image carrying surface;

driving means for providing a driving force;

a tractor, provided at upstream side of said transfer guide means relative to the feeding direction of the continuous paper and responsive to the driving force supplied thereto, for feeding the continuous paper at a tractor feed velocity and responsive to a termination of the driving force for terminating the tractor feed velocity;

roller means, provided at a downstream side of said transfer guide means relative to the direction of movement of the continuous paper, the roller means engaging the continuous paper and being responsive to the driving force supplied thereto for rotating at a roller rotation rate and producing a corresponding roller feed rate for feeding the engaged continuous paper at the roller feed rate and, further, responsive to the termination of supply of the driving force thereto for being decoupled from the driving means and continuing to rotate due to inertia at a rotation rate and corresponding roller feed rate which is greater than the tractor feed rate following termination of the supply of the driving force to the tractor;

control means, operatively coupled to said driving means, for selectively controlling the energizing of the driving means, said control means energizing the driving means during the first time interval and discontinuing the energizing of the driving means during the second time interval.

22. An image forming apparatus as recited in claim 21, wherein: said transfer guide means moves the continuous paper to a first, transfer position at which the portion of the continuous paper contacts said toner carrying member at the first surface velocity and in the associated first direction of movement and to a second separated position at which the continuous paper is displaced from said toner carrying member.

23. An image forming apparatus as recited in claim 22, wherein:

a feeding path defined by said tractor, said transfer guide means and said roller means comprises a curved path.

24. An image forming apparatus as recited in claim 23, further comprising:

a flash fixing apparatus provided in the feeding path between said transfer guide means and said roller means.

25. An image forming apparatus as recited in claim 24, wherein:

said roller means comprises a scuff roller.

26. An image forming apparatus as recited in claim 25, wherein said guide means comprises:

a guide plate moveable between the first, transfer position and a separated position; and a motor for moving said guide plate.

27. An image forming apparatus as recited in claim 21, wherein:

a feeding path, defined by said transfer guide means and said roller means, comprises a curved path.

28. An image forming apparatus as recited in claim 27, further comprising:

a flash fixing apparatus provided in the feeding path between said transfer guide means and said roller means.

29. An image forming apparatus as recited in claim 28, wherein said roller means comprises a scuff roller.

30. An image forming apparatus as recited in claim 29, wherein said guide means comprises:

a guide plate moveable between transfer position and a separated position; and a motor for moving said guide plate.

31. An image forming apparatus using paper from a continuous paper supply, comprising:

a toner carrying member carrying a toner image;

transfer guide means for moving the continuous paper so that the continuous paper is contacted with said toner carrying member and is separated from said toner carrying member;

front side feeding means, provided at an upstream side of said transfer guide member relative to the feeding direction of the continuous paper, for feeding the continuous paper;

backside feeding means, provided at a downstream side of said transfer guide member relative to the feeding direction of the continuous paper, for feeding the continuous paper; and control means for controlling said front side feeding means and said back side feeding means so that a feeding velocity of said back side feeding means feeds the continuous paper at a velocity faster than a feeding velocity of said front side feeding means during a moving operation in which the continuous paper is moved by said transfer guide means.

32. An image forming apparatus as recited in claim 31, wherein said first transfer guide means moves the continuous paper from a transfer position at which the continuous paper contacts said toner carrying member and toward a second, separate position at which the continuous paper is displaced from said toner carrying member.

33. An image forming apparatus as recited in claim 32, wherein:

a feeding path defined by said front side feeding means, said transfer guide means and said backside feeding means comprises a curved path.

34. An image forming apparatus as recited in claim 33, further comprising:

a flash fixing apparatus provided in the feeding path between said transfer guide means and said backside feeding means.

35. An image forming apparatus as recited in claim 34, wherein:

said backside feeding means comprises a scuff roller.

36. An image forming apparatus as recited in claim 35, wherein said guide means comprises:

a guide plate selectively moveable between the first, transfer position and the second, separate position; and a motor for selectively moving said guide plate between said first and second positions.

37. An image forming apparatus as recited in claim 31, wherein:

a feeding path defined by said front side feeding means, said transfer guide means, and said backside feeding means comprises a curved path.

38. An image forming apparatus as recited in claim 37, further comprising:

a flash fixing apparatus provided in the feeding path between said transfer guide means and said backside feeding means.

39. An image forming apparatus as recited in claim 38, wherein:

said backside feeding means comprises a scuff roller.

40. An image forming apparatus as recited in claim 39, wherein said guide means comprises:

a guide plate selectively moveable between the first, transfer position and the second, separate position; and a motor for selectively moving said guide plate between said first and second positions.

41. An image forming apparatus using paper from a continuous paper supply, comprising:

a toner carrying member carrying a toner image;

transfer guide means for moving the continuous paper so that the continuous paper is contacted with said toner carrying member and is separated from said toner carrying member;

front side feeding means, provided at upstream side of said transfer guide means relative to the feeding direction of the continuous paper, for feeding the continuous paper;

backside feeding means, provided at a downstream side of said transfer guide means relative to the feeding direction of the continuous paper, for feeding the continuous paper; and means for detecting a feeding velocity of the continuous paper;

means for determining a slip state of the continuous paper based upon the feeding velocity detected by said detecting means; and control means for controlling said front side feeding means and said backside feeding means in accordance with the slip state so that a feeding velocity of said backside feeding means feeds the continuous paper at a velocity faster than a feeding velocity of said front side feeding means during a moving operation in which the continuous paper is moved by said transfer guide means.

42. An image forming apparatus as recited in claim 41, wherein said transfer guide means moves the continuous paper from a first, transfer position at which the continuous paper contacts said toner carrying member and toward a second, separate position at which the continuous paper is displaced from said toner carrying member.

43. An image forming apparatus as recited in claim 42, wherein:

a feeding path defined by said frontside feeding means, said transfer guide means and said backside feeding means comprises a curved path.

44. An image forming apparatus as recited in claim 43, further comprising:

a flash fixing apparatus provided in the feeding path between said transfer guide means and backside feeding means.

45. An image forming apparatus as recited in claim 44, wherein:

said backside feeding means comprises a scuff roller.

46. An image forming apparatus as recited in claim 45, wherein said guide means comprises:

a guide plate selectively moveable between the first, transfer position and the second, separate position; and a motor for selectively moving said guide plate between said first and second positions.

47. An image forming apparatus as recited in claim 41, wherein:

a feeding path defined by said frontside feeding means, said transfer guide means, and said backside feeding means comprises a curved path.

48. An image forming apparatus as recited in claim 47, further comprising:

a flash fixing apparatus provided in the feeding path between said transfer guide means and said backside feeding means.

49. An image forming apparatus as recited in claim 48, wherein:

said backside feeding means comprises a scuff roller.

50. An image forming apparatus as recited in claim 49, wherein said guide means comprises:

a guide plate selectively moveable between the first, transfer position and the second, separate position; and a motor for selectively moving said guide plate between said first and second positions.

51. An image forming apparatus using paper of a continuous paper supply, comprising:

a toner carrying member carrying a toner image;

transfer guide means for moving the continuous paper supply, so that the continuous paper is contacted with said toner carrying member and is separated from said toner carrying member;

front side feeding means, provided at upstream side of said transfer guide means in view of a feeding direction of the continuous paper supply, for feeding the continuous paper supply;

back side feeding means, provided at a downstream side of said transfer guide means in view of a direction of the continuous paper, for feeding the continuous paper; and means for inputting type information indicating a type of the continuous paper;

control means for controlling said front side feeding means and said back side feeding means in accordance with the type information so that a feeding velocity of said back side feeding means feeds the continuous paper at a velocity faster than a feeding velocity of said front side feeding means during a moving operation which the continuous paper is moved by said transfer guide means.

52. An image forming apparatus as recited in claim 51, wherein said transfer guide means moves the continuous paper from a first, transfer position at which the continuous paper contacts said toner carrying member and toward a second, separate position at which the continuous paper is displaced from said toner carrying member.

53. An image forming apparatus as recited in claim 52, wherein:

a feeding path defined by said frontside feeding means, said transfer guide means and said backside feeding means comprises a curved path.

54. An image forming apparatus as recited in claim 53, further comprising:

a flash fixing apparatus provided in the feeding path between said transfer guide means and said backside feeding means.

55. An image forming apparatus as recited in claim 54, wherein:

said backside feeding means comprises a scuff roller.

56. An image forming apparatus as recited in claim 55, wherein said guide means comprises:

a guide plate selectively moveable between the first, transfer position and the second, separate position; and a motor for selectively moving said guide plate between said first and second positions.

57. An image forming apparatus as recited in claim 51, wherein:

a feeding path defined by said frontside feeding means, said transfer guide means, and said backside feeding means comprises a curved path.

58. An image forming apparatus as recited in claim 57, further comprising:

a flash fixing apparatus provided in the feeding path between said transfer guide means and said backside feeding means.

59. An image forming apparatus as recited in claim 58, wherein:

said backside feeding means comprises a scuff roller.

60. An image forming apparatus as recited in claim 59, wherein said guide means comprises:

a guide plate selectively moveable between the first, transfer position and the second, separate position; and a motor for selectively moving said guide plate between said first and second positions.

* * * * *

UNITED STATES PATENT AND TRADEMARK OFFICE

CERTIFICATE OF CORRECTION

PATENT NO. : 5,481,352

DATED : Jan. 2, 1996

INVENTOR(S) : YAMAMOTO et al.

It is certified that error appears in the above-indentified patent and that said Letters Patent is hereby corrected as shown below:

Col. 21, line 44 (claim 21, line 37), after "tractor;" insert --and--.

Col. 23, line 65 (claim 43, line 3), change "frontside" to --front side--.

Signed and Sealed this

Ninth Day of July, 1996

*Attest:*

*Attesting Officer*

BRUCE LEHMAN

*Commissioner of Patents and Trademarks*